US009193162B2

(12) United States Patent
Owaki et al.

(10) Patent No.: US 9,193,162 B2
(45) Date of Patent: Nov. 24, 2015

(54) LIQUID EJECTING HEAD AND LIQUID EJECTING APPARATUS WITH A RIB WHICH DIVIDES THE FLOW OF THE LIQUID INSIDE THE MANIFOLD IN TWO

(71) Applicant: Seiko Epson Corporation, Shinjuku-ku (JP)

(72) Inventors: Hiroshige Owaki, Okaya (JP); Hiroyuki Hagiwara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/566,606

(22) Filed: Dec. 10, 2014

(65) Prior Publication Data

US 2015/0165767 A1 Jun. 18, 2015

(30) Foreign Application Priority Data

Dec. 17, 2013 (JP) ..... 2013-260686

(51) Int. Cl.
*B41J 2/19* (2006.01)
*B41J 2/14* (2006.01)

(52) U.S. Cl.
CPC *B41J 2/1433* (2013.01); *B41J 2/19* (2013.01); *B41J 2002/14419* (2013.01)

(58) Field of Classification Search
CPC ..... B41J 2/19; B41J 2/20; B41J 2/14145; B41J 2/17556; B41J 2/17563
USPC ..... 347/68, 70, 71, 92–94
See application file for complete search history.

(56) References Cited

U.S. PATENT DOCUMENTS 5,808,644 A * 9/1998 Imamura et al. ..... 347/93

FOREIGN PATENT DOCUMENTS

| | | | |
|---|---|---|---|
| JP | 3161095 | B | 5/1994 |
| JP | 2009-247938 | A | 10/2009 |
| JP | 2013-230659 | A | 11/2013 |

* cited by examiner

*Primary Examiner* — Juanita D Jackson
(74) *Attorney, Agent, or Firm* — Kilpatrick Townsend & Stockton LLP

(57) ABSTRACT

A liquid ejecting head includes: a pressure generation chamber that communicates with a nozzle opening; a pressure generation unit that generates a change in a pressure in the pressure generation chamber; a manifold that communicates with a plurality of pressure generation chambers; and a rib that is provided inside the manifold, in which the rib is formed over the manifold in a direction intersecting a liquid flowing inside the manifold, and in which a notch section that divides the flow inside the manifold into two is provided in the rib.

16 Claims, 13 Drawing Sheets

LIQUID EJECTING HEAD AND LIQUID EJECTING APPARATUS WITH A RIB WHICH DIVIDES THE FLOW OF THE LIQUID INSIDE THE MANIFOLD IN TWO

BACKGROUND

1. Technical Field

The present invention relates to a liquid ejecting head ejecting a liquid from nozzle openings and a liquid ejecting apparatus, and, specifically, to an ink jet type recording head ejecting ink as the liquid and an ink jet type recording apparatus.

2. Related Art

As an ink jet type recording head that is a representative example of a liquid ejecting head ejecting liquid droplets, for example, there is an ink jet type recording head that includes nozzle openings and a flow path of a pressure generation chamber communicating with the nozzle openings and the like, in which ink droplets are ejected from the nozzle openings by generating a pressure change in ink inside the pressure generation chamber caused by a pressure generation unit.

In such an ink jet type recording head, components contained in the ink evaporate from the nozzle openings so that the ink is thickened and variation occurs in ejection characteristics of the ink droplets with elapse of time, and then ejection quality of the liquid cannot be maintained to be constant. Furthermore, if the components contained in the ink settle and a difference occurs between components of the ink droplets when continuously ejecting the ink and components of the ink droplets when ejecting the ink at time intervals, variation also occurs in the ejection quality of the liquid.

Thus, an ink jet type recording head is suggested in which ink is supplied to a manifold that is a common liquid chamber communicating commonly with a plurality of pressure generation chambers and the ink is recovered from the manifold, and the ink is circulated by repeating the supply and recovery, thereby thickening of the ink and settling of the components contained in the ink being suppressed (for example, see JP-A-2009-247938 and Japanese Patent No. 3161095).

However, even if the ink inside the manifold is circulated, a temperature difference (temperature gradient) occurs between a temperature of a center of ink flow inside the manifold and a temperature of the ink inside the pressure generation chamber to which the ink is supplied from the manifold, and even if the ink having a desired temperature is circulated inside the manifold, the temperature of the ink inside the pressure generation chamber is lower than that of the ink inside the manifold so that there are problems that the ink cannot be ejected at an optimum temperature and optimum ejection characteristics cannot be obtained.

Furthermore, if a volume of the manifold is reduced, a temperature gradient of the ink between a side of a liquid ejecting surface and a side opposite to the liquid ejecting surface inside the manifold or a temperature gradient of the ink in an arrangement direction of the pressure generation chambers can be reduced, but there are problems that pressure loss is increased, a change in a pressure of the pressure generation unit cannot be absorbed on the side of the manifold, crosstalk occurs, and the like.

Thus, a configuration is disclosed in which a temperature gradient of ink inside a manifold is suppressed by providing a protrusion section within the manifold without remarkably reducing a volume of the manifold (for example, see JP-A-2013-230659).

However, in JP-A-2013-230659, a center of ink flow flowing inside the manifold is moved and the temperature gradient of the ink inside the manifold can be suppressed by providing a protrusion section inside the manifold, but there are problems that air bubbles stagnate in a corner portion and the like formed by the protrusion section and a wall surface of the manifold and the air bubbles enter the pressure generation chamber and the like at an unexpected timing, and there is a concern that defects such as ink ejection failure may occur.

Furthermore, when the air bubbles stagnating inside the manifold grow, there are problems that the air bubbles becomes a buffer to a region facing the air bubbles in the pressure generation chamber communicating with the manifold and affect a pressure fluctuation in the pressure generation chamber, a variation in the pressure fluctuation occurs between the pressure generation chamber communicating with the manifold in the region facing the air bubbles and the pressure generation chamber communicating with the manifold in a region not facing the air bubbles, and there is a concern that a variation occurs in ejection characteristics of ink droplets.

Moreover, such problems also similarly exist in a liquid ejecting head ejecting a liquid other than ink in addition to the ink jet type recording head.

SUMMARY

An advantage of some aspects of the invention is to provide a liquid ejecting head in which a temperature gradient of a liquid inside a manifold can be suppressed and an air bubble discharge property inside the manifold can be improved and a liquid ejecting apparatus.

According to an aspect of the invention, there is provided a liquid ejecting head including: a pressure generation chamber that communicates with a nozzle opening; a pressure generation unit that generates a change in a pressure in the pressure generation chamber; a manifold that communicates with a plurality of pressure generation chambers; and a rib that is provided inside the manifold, in which the rib is formed over the manifold in a direction intersecting a liquid flowing inside the manifold, and in which a notch section that divides the flow inside the manifold into two is provided in the rib.

In this case, it is possible to suppress a temperature gradient by dividing the flow of the liquid into two inside the manifold by providing the rib inside the manifold. Furthermore, since the flow of the liquid inside the manifold is divided into two, air bubbles are unlikely to stagnate and it is possible to improve an air bubble discharge property.

In the liquid ejecting head, it is preferable that the manifold include a first side and a second side that face each other in a direction crossing the flowing direction of the liquid, and a third side and a fourth side that face each other in a direction intersecting a direction facing the first side and the second side, the manifold and the pressure generation chamber communicate with each other on a side of a corner portion at which the first side and the fourth side of the manifold are connected, and the rib be configured such that one end thereof is connected to at least one of the first side and the third side, and the other end is connected to the other side of the first side and the third side, and to at least one side selected from the second side and the fourth side. In this case, it is possible to improve rigidity of a member in which the manifold is formed by the rib and to improve the air bubble discharge property.

Furthermore, it is preferable that the rib be formed over a diagonal line of the manifold when the manifold is viewed in the flowing direction. In this case, it is possible to improve rigidity of the member in which the manifold is formed by the rib.

Furthermore, it is preferable that the manifold be formed in such a manner that a concave section provided in a first member is covered by a second member. In this case, it is possible to form the manifold having a large volume in the first member.

Furthermore, it is preferable that the liquid ejecting head further include an outflow path through which the liquid inside the manifold flows out. In this case, it is possible to circulate the liquid that is heated to a desired temperature inside the manifold.

Furthermore, it is preferable that a plurality of ribs be provided inside the manifold in the flowing direction of the liquid and the plurality of ribs be positioned in different positions viewed from the flowing direction of the liquid. In this case, it is possible to suppress the temperature gradient by further dispersing the liquid inside the manifold.

Furthermore, according to another aspect of the invention, there is provided a liquid ejecting apparatus including the liquid ejecting head of the above aspects.

In this case, it is possible to suppress the temperature gradient of the liquid inside the manifold and to improve the air bubble discharge property inside the manifold.

In the liquid ejecting apparatus, it is preferable that a plurality of liquid ejecting heads be provided in a direction in which liquid ejecting surfaces from which nozzle openings open intersect each other. In this case, it is possible to improve the air bubble discharge property even if air bubbles are likely to stagnate by inclining the liquid ejecting head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail with reference to embodiments.

First Embodiment

Figure 1:
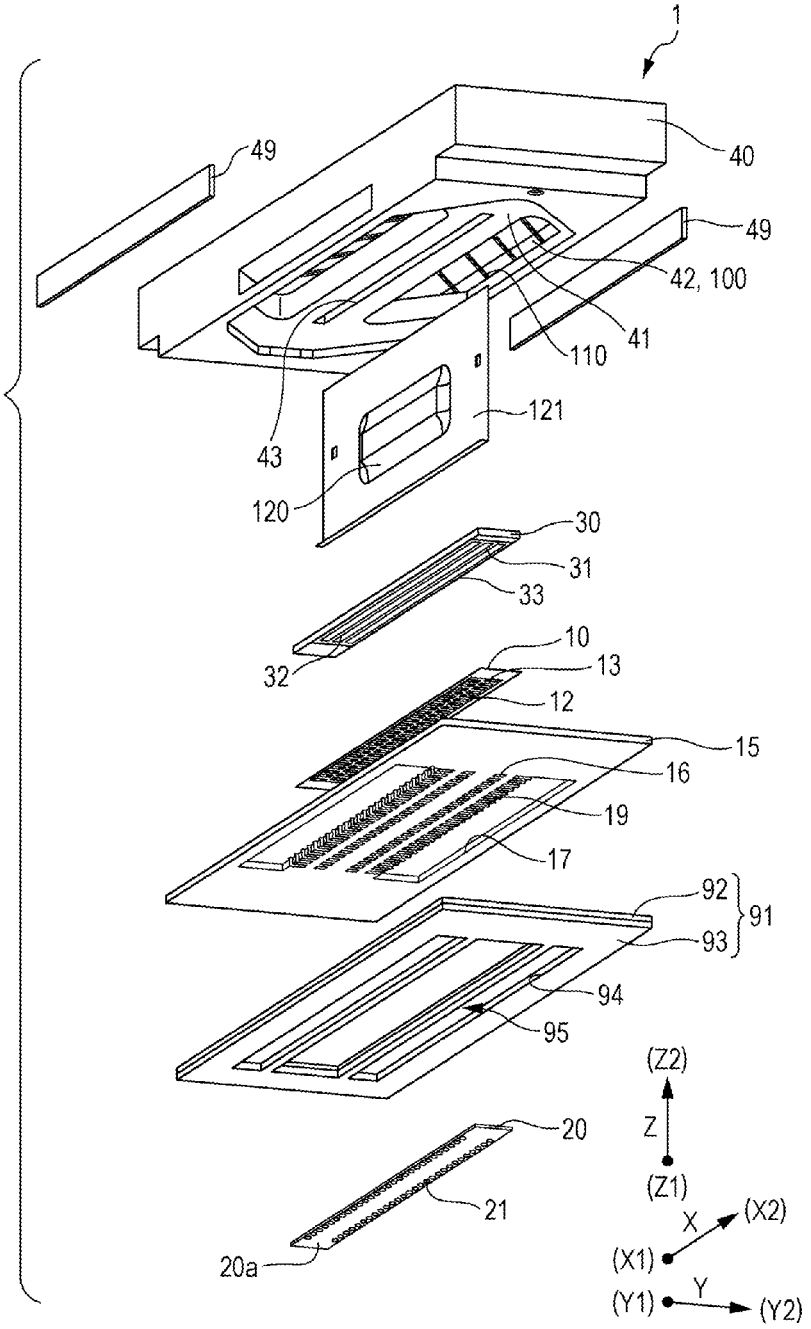
FIG. 1 is an exploded perspective view of a recording head according to a first embodiment.
Figure 2:
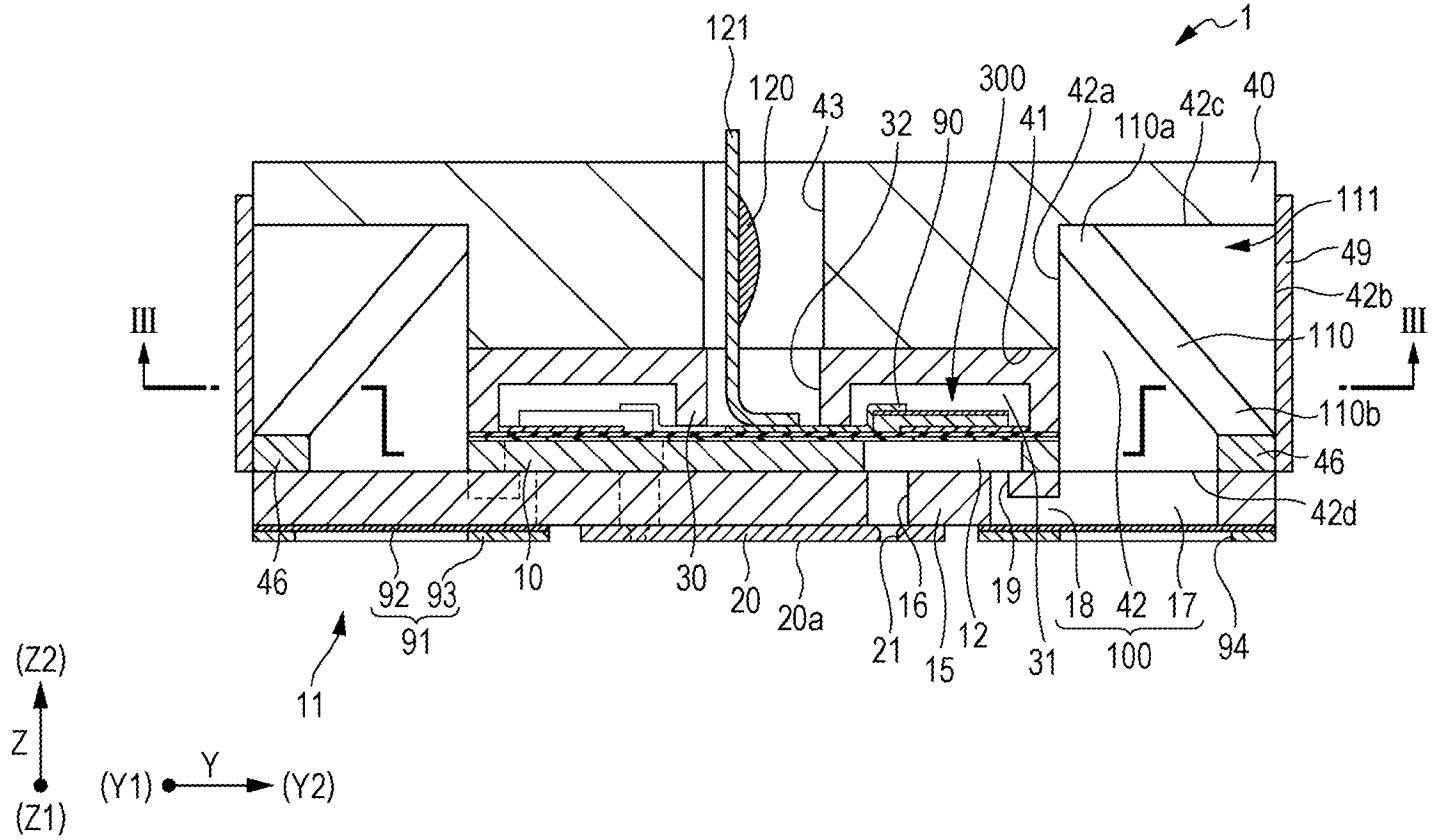
FIG. 2 is a cross-sectional view of the recording head according to the first embodiment.
Figure 3:
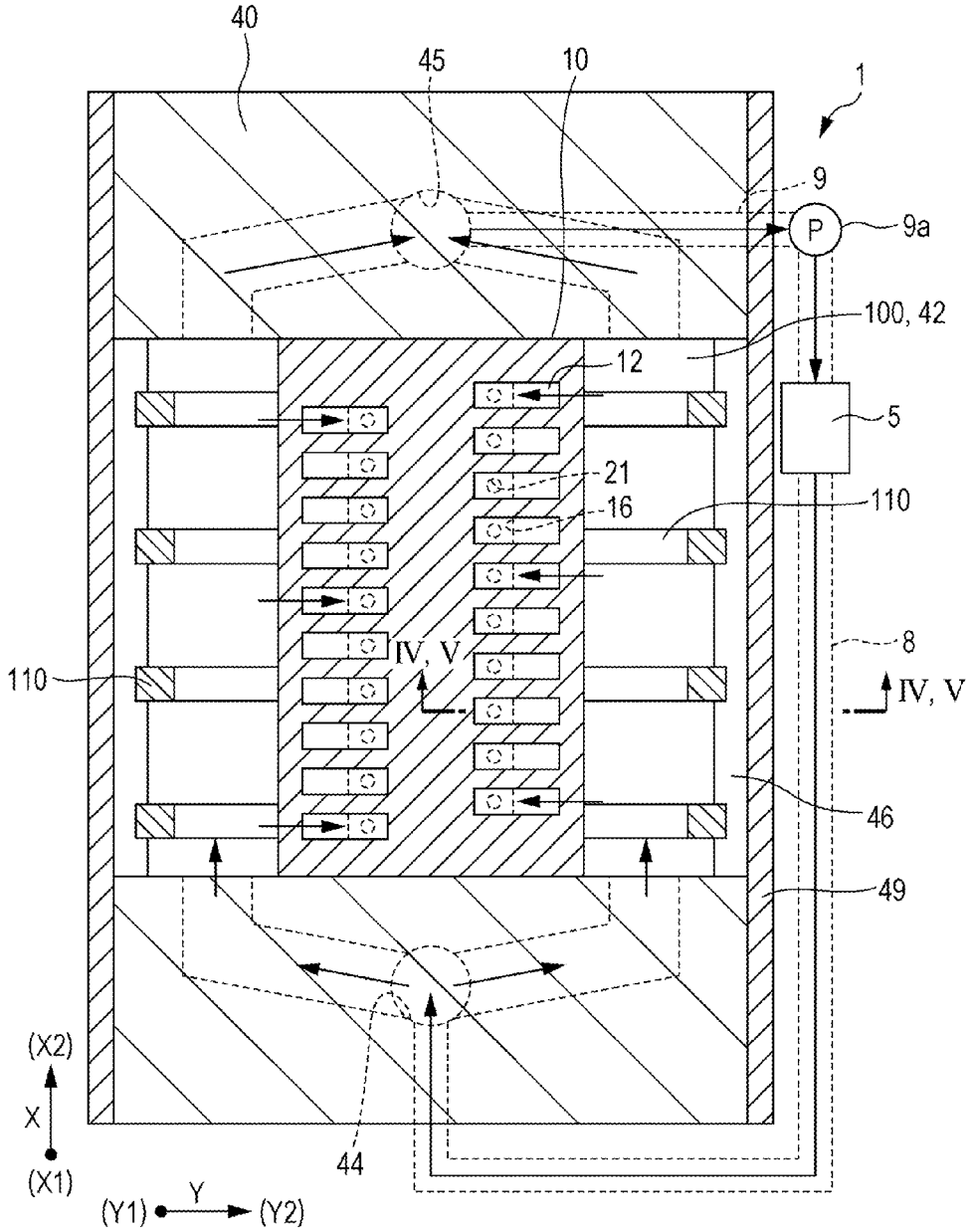
FIG. 3 is a cross-sectional view of the recording head according to the first embodiment.
Figure 4A:
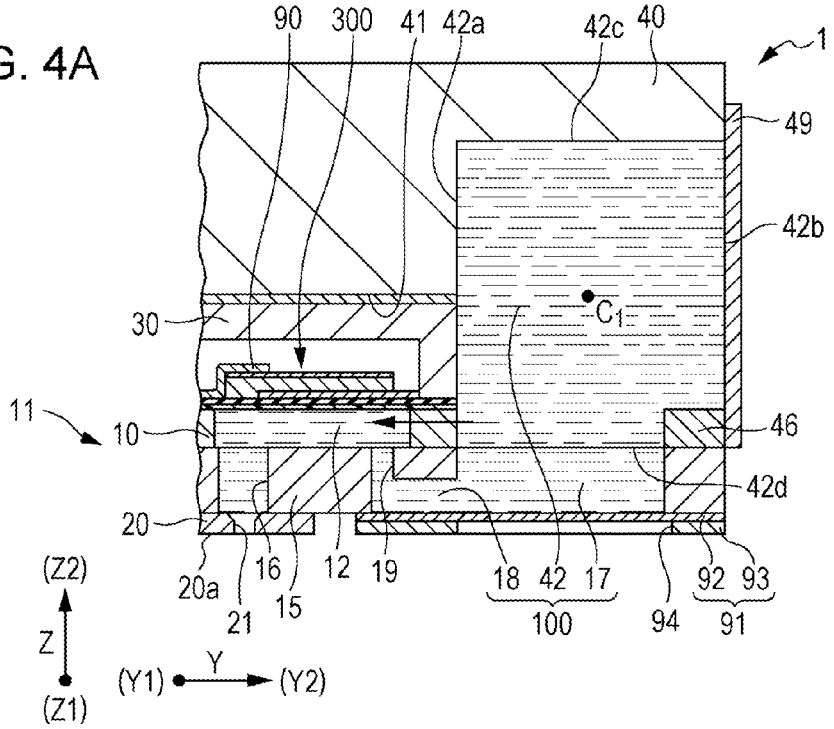
FIGS. 4A and 4B are cross-sectional views illustrating flows of liquids inside the recording head of the first embodiment and a recording head of a comparison.
Figure 4B:
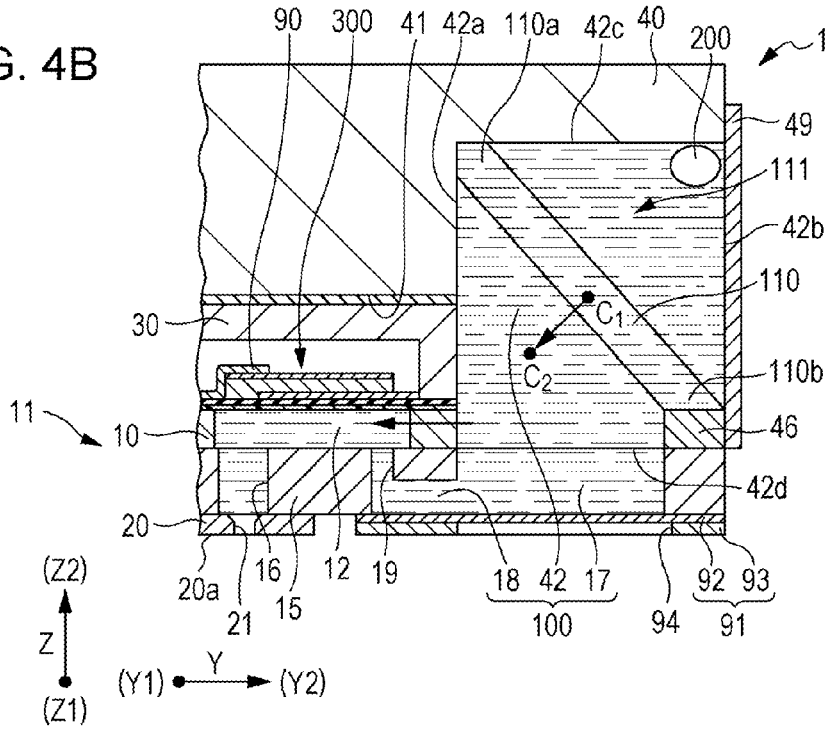
Figure 5:
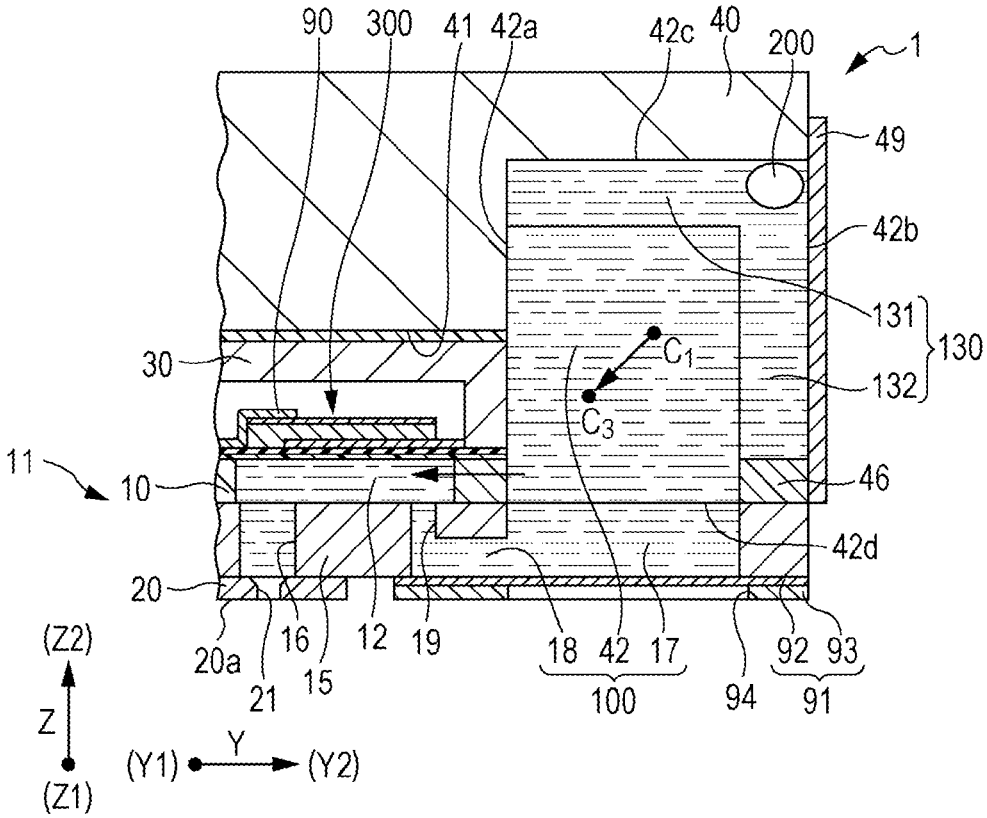
FIG. 5 is a cross-sectional view illustrating the flow of the liquid inside the recording head of the comparison.

FIG. 1 is an exploded perspective view of an ink jet type recording head according to a first embodiment of the invention, FIG. 2 is a cross-sectional view of the ink jet type recording head, FIG. 3 is a cross-sectional view that is taken along line III-III of FIG. 2, FIGS. 4A to 5 are cross-sectional views according to line IV-IV, V-V of FIG. 3, FIG. 4B is a cross-sectional view of a main portion of the ink jet type recording head according to the first embodiment of the invention, and FIGS. 4A and 5 are cross-sectional views of a main portion of an ink jet type recording head of a comparison.

As illustrated in the views, an ink jet type recording head 1 includes a plurality of members such as a head body 11 and a case member 40 that is a first member, and the plurality of members are bonded by adhesive and the like. In the embodiment, the head body 11 includes a flow path forming substrate 10, a communication plate 15, a nozzle plate 20, a protection substrate 30, and a compliance substrate 91.

As illustrated in FIGS. 2 and 3, a plurality of pressure generation chambers 12 are arranged in the flow path forming substrate 10 configuring the head body 11 along a direction in which a plurality of nozzle openings 21 are arranged. Hereinafter, this direction is referred to as an arrangement direction of the pressure generation chambers 12 or a first direction X. Furthermore, a plurality of columns (two columns in the embodiment) in which the pressure generation chambers 12 are arranged in the first direction X are provided in the flow path forming substrate 10. Hereinafter, an arrangement direction in which the plurality of columns of the pressure generation chambers 12 are arranged is referred to as a second direction Y. Moreover, in two columns of the pressure generation chambers 12 arranged in the first direction X, one column of the pressure generation chambers 12 is disposed in a position deviated in the first direction X by half of an interval of the pressure generation chambers 12 adjacent to each other in the first direction X with respect to the other column of the pressure generation chambers 12. Thus, specifically, similar to the nozzle openings 21 described below, two columns of the nozzle openings 21 are arranged to be deviated in the first direction X by half of the interval, thereby resolution in the first direction X being doubled. Of course, the positions of the two columns of the pressure generation chambers 12 are equal to each other in the first direction X and different ink may be supplied to each column of the pressure generation chambers 12. Furthermore, in the embodiment, a direction orthogonal to the first direction X and the second direction Y is referred to as a third direction Z.

Moreover, the flow path forming substrate 10 may be provided with a supply path of which an opening area is smaller than that of pressure generation chamber on one end side of the pressure generation chambers 12 in the second direction Y and which gives a flow path resistance for the ink flowing into the pressure generation chamber 12.

The communication plate 15 is bonded to a surface of the flow path forming substrate 10 on a Z1 side in the third direction Z, which is on a side of a liquid ejecting surface 20*a*. Furthermore, the nozzle plate 20 in which the nozzle openings 21 are provided is bonded on a Z1 side of the communication plate 15 in the third direction Z. In the embodiment, the surface of the nozzle plate 20 on the Z1 side in the third direction Z in which the nozzle openings 21 open is the liquid ejecting surface 20*a*.

The communication plate 15 is provided with a nozzle communication path 16 communicating with the pressure generation chambers 12 and the nozzle openings 21. The communication plate 15 has an area greater than that of the flow path forming substrate 10 and the nozzle plate 20 has an area smaller than that of the flow path forming substrate 10. As described above, it is possible to reduce costs by relatively decreasing the area of the nozzle plate 20. Moreover, the area referred to herein is an area in a plane direction having the first direction X and the second direction Y.

Furthermore, the communication plate 15 is provided with a first manifold section 17 and a second manifold section 18 configuring a part of a manifold 100.

The first manifold section 17 is provided as passing through the communication plate 15 in the third direction Z.

Furthermore, the second manifold section 18 is provided in the communication plate 15 on the side of the nozzle plate 20, that is, is open on the Z1 side and provided to the middle in the third direction Z, without passing the communication plate 15 through the third direction Z.

Furthermore, the communication plate 15 is provided with supply communication paths 19 communicating with one end portion of the pressure generation chambers 12 in the second direction Y, independently for each pressure generation chamber 12. The supply communication path 19 passes through the communication plate 15 in the third direction Z and communicates with the second manifold section 18 and the pressure generation chambers 12.

On the other hand, a vibration plate is formed on a side of the flow path forming substrate 10 opposite to the communication plate 15, that is, on a Z2 side. Furthermore, a piezoelectric actuator 300 that is the pressure generation unit of the embodiment is configured of a first electrode, a piezoelectric layer, and a second electrode which are sequentially laminated on the vibration plate. Generally, one electrode of the piezoelectric actuator 300 is a common electrode and the other electrode and the piezoelectric layer are configured by patterning for each pressure generation chamber 12.

Furthermore, a protection substrate 30 having a size substantially the same as that of the flow path forming substrate 10 is bonded to the flow path forming substrate 10 on the side of the piezoelectric actuator 300, that is, to a surface on the Z2 side. The protection substrate 30 has a holding section 31 that is a space for protecting the piezoelectric actuator 300. Furthermore, the protection substrate 30 is provided with a through hole 32 passing through in the third direction Z. An end portion of a lead electrode 90 drawn out from the electrode of the piezoelectric actuator 300 extends so as to be exposed to the through hole 32 and the lead electrode 90 and a wiring substrate 121 on which a driving circuit 120 such as a driving 1C is mounted are electrically connected to each other inside the through hole 32.

Furthermore, the case member 40 defining the manifold 100 communicating with the plurality of pressure generation chambers 12 together with the head body 11 is fixed to the protection substrate 30 and the communication plate 15. The case member 40 has the substantially same shape as that of the communication plate 15 described above in a plan view from the third direction Z and is bonded to the protection substrate 30, and is also bonded to the communication plate 15 described above. Specifically, the case member 40 has a concave section 41 having a depth in which the flow path forming substrate 10 and the protection substrate 30 are accommodated on the side of the protection substrate 30. The concave section 41 has an opening area wider than the surface of the protection substrate 30 bonded to the flow path forming substrate 10. Then, in a state where the flow path forming substrate 10 and the like are accommodated in the concave section 41, an opening surface of the concave section 41 on the side of the nozzle plate 20 is sealed by the communication plate 15. Furthermore, the concave section 41 of the case member 40 is provided by being open to a surface in the second direction Y and the opening of the concave section 41 in the second direction Y is sealed by a lid member 49 that is a second member. Therefore, a third manifold section 42 is defined by the case member 40, the head body 11, and the lid member 49 in an outer periphery portion of the flow path forming substrate 10. As described above, the concave section 41 forming the third manifold section 42 is open to a side surface in the second direction Y and the opening is sealed by the lid member 49, thereby the third manifold section 42 having a relatively large volume being able to be formed. Furthermore, in the embodiment, the opening of the concave section 41 to the side surface of the case member 40 in the second direction Y is positioned in a position separated from the end surface on the Z1 side in the third direction by a predetermined distance on the Z2 side. That is, the opening of the concave section 41 in the second direction Y of the case member 40 is not connected to an end surface on the Z1 side in the third direction Z. Therefore, a beam section 46 is formed at a corner portion between the side surface in the second direction Y and the end surface on the Z1 side in the third direction Z in the case member 40. The beam section 46 of the embodiment is provided along the first direction X so as to cross the opening of the concave section 41 in the second direction Y and the opening on the Z1 side in the third direction Z. As described above, it is possible to improve the rigidity of the case member 40 by providing the beam section 46 and to easily seal the opening of the concave section 41 simply by bonding the lid member 49 to the beam section 46. That is, if the concave section 41 is continuously open throughout the side surface in the second direction Y and the end surface on the Z1 side in the third direction Z without providing the beam section 46, the rigidity of the case member 40 is decreased and a bonding region of the lid member 49 is eliminated, and bonding of the lid member 49 becomes difficult.

Then, as described above, the manifold 100 of the embodiment is configured by the third manifold section 42 that is formed by the case member 40, the head body 11, and the lid member 49, and the first manifold section 17 and the second manifold section 18 that are provided in the communication plate 15. Moreover, in the embodiment, manifolds 100 are formed on both sides of the head body 11 in the second direction Y. Of course, the manifold 100 is not specifically limited and, for example, may be configured of only the third manifold section 42, and may be configured of the second manifold section 18 and the third manifold section 42. However, as the embodiment, it is possible to form the manifold 100 having a relatively large volume by configuring the manifold 100 with the first manifold section 17, the second manifold section 18, and the third manifold section 42 without increasing the size of the ink jet type recording head 1.

Furthermore, the case member 40 is provided with a connection port 43 that communicates with the through hole 32 of the protection substrate 30 and passes through the case member 40 in the third direction Z. The wiring substrate 121 passing through the connection port 43 passes through the through hole 32 and is connected to the lead electrode 90.

Furthermore, as illustrated in FIG. 3, the case member 40 is provided with an inflow path 44 which communicates with the manifold 100 and supplies ink to the manifold 100, and an outflow path 45 which communicates with the manifold 100 and through which the ink inside the manifold 100 flows out. The inflow path 44 is provided on one side of the head body 11 in the first direction X and the outflow path 45 is provided on the other side of the head body 11 in the first direction X. A side of the inflow path 44 of the embodiment that is connected to a liquid storage unit 5 provided outside the ink jet type recording head 1 through a supply pipe 8 is connected as one portion and the inflow path 44 branches into two in the middle thereof and communicates with the manifolds 100 on both sides of the head body 11 in the second direction Y, respectively. Furthermore, two outflow paths 45 communicating with two manifolds 100, respectively merge into one in the middle thereof and are connected to a recovery pipe 9. That is, the inflow path 44 that supplies the same ink branches into two in the middle thereof and supplies the same ink to two manifolds 100. Furthermore, the outflow paths 45 communicating with the manifolds 100, respectively merge in the middle thereof and the ink inside the manifolds 100 flows out from one outlet. Of course, an inflow path 44 may be independently provided for each manifold 100 without branching the inflow path 44 in the middle thereof and an outflow path 45 may be independently provided for each manifold 100 without merging outflow paths 45 in the middle thereof.

Furthermore, as illustrated in FIG. 2, a compliance substrate 91 is provided on a surface in which the first manifold section 17 and the second manifold section 18 of the communication plate 15 are open. The compliance substrate 91 seals the opening of the first manifold section 17 and the second manifold section 18.

In the embodiment, such a compliance substrate 91 includes a sealing film 92 and a fixing substrate 93. The sealing film 92 is formed of a thin film (for example, polyphenylene sulfide (PPS) or stainless steel (SUS)) having flexibility and the like. Furthermore, the fixing substrate 93 is formed of a hard material of metal and the like such as stainless steel (SUS). Since a region of the fixing substrate 93 facing the manifold 100 is an opening section 94 that is completely removed in a thickness direction, one surface of the manifold 100 is a compliance section 95 that is a flexible section sealed only by the sealing film 92 having flexibility.

Here, as illustrated in FIGS. 2, 3, and 4B, ribs 110 are provided inside the manifold 100, that is, in the embodiment, are provided inside the third manifold section 42 over the manifold 100 in a direction intersecting the first direction X that is the flowing direction of the ink inside the manifold 100, in the middle in the direction of the flow of the ink, that is, a direction from X1 of the inflow path 44 to X2 of the outflow path 45. In the embodiment, a plurality of, for example, four ribs 110 are provided in one manifold 100 with constant intervals in the first direction X.

The rib 110 divides the flow of the ink flowing inside the manifold 100 into two. That is, as illustrated in FIG. 4B, when the flow of the ink is illustrated in a transverse cross section, one end 110*a* and the other end 110*b* of the rib 110 are connected to the manifold 100, that is, sides of the third manifold section 42 in the embodiment. That is, it may be said that the rib 110 provided over the manifold 100 is that one end 110*a* and the other end 110*b* of the rib 110 are connected to the sides of the manifold 100. Specifically, the third manifold section 42 that is provided in the case member 40 in the first manifold section 17, the second manifold section 18, and the third manifold section 42 configuring the manifold 100 of the embodiment has a first side 42*a* and a second side 42*b* that face each other in a direction crossing the flowing direction of the ink, that is, in the second direction Y in a plane direction including the second direction Y and the third direction Z, and a third side 42*c* and a fourth side 42*d* that face each other in a direction intersecting the second direction Y that is the direction in which the first side 42*a* and the second side 42*b* face each other, that is, in the third direction Z. In the embodiment, since the direction in which the first side 42*a* and the second side 42*b* face each other and the direction in which the third side 42*c* and the fourth side 42*d* face each other are the second direction Y and the third direction Z, respectively, they are orthogonal to each other. Therefore, the third manifold section 42 has a cross section of a substantially rectangular shape. Moreover, in the embodiment, as described above, since the third manifold section 42 is provided with the beam section 46, the third manifold section 42 has a shape in which one corner portion of the space having a cross section of a rectangular shape is cut off by the rectangular beam section 46. Furthermore, in the embodiment, the first direction X, the second direction Y, and the third direction Z are disposed in directions orthogonal to each other, but are not specifically limited to the embodiment, and may be directions intersecting each other in addition to the orthogonal directions.

Then, one end 110*a* of the rib 110 of the embodiment is provided over the first side 42*a* and the third side 42*c*, that is, is provided by connecting to the corner portion that is formed by the first side 42*a* and the third side 42*c*. Furthermore, the other end 110*b* of the rib 110 is provided by connecting to the fourth side 42*d*. That is, in the embodiment, the beam section 46 is provided and since the second side 42*b* is a side facing the first side 42*a*, the second side 42*b* also includes a surface of the beam section 46 facing the first side 42*a*. Similarly, the fourth side 42*d* is a side facing the third side 42*c* and also includes a surface of the beam section 46 facing the third side 42*c*. Furthermore, the first side 42*a* to the fourth side 42*d* of the third manifold section 42 of the embodiment represent sides of the space and do not represent inner wall surfaces. That is, the third manifold section 42 communicates with the first manifold section 17 on the Z1 side in the third direction Z, and a wall surface does not exist in the fourth side 42*d* of the third manifold section 42. Then, in the embodiment, the other end portion of the rib 110 is connected to the fourth side 42*d* that is formed by the beam section 46. That is, the other end portion of the rib 110 is provided by connecting to the fourth side 42*d* that is a surface of the beam section 46 on the Z2 side of the third direction Z. That is, the rib 110 is formed so as to connect the corner portions of the third manifold section 42.

Furthermore, a notch section 111 is formed in the rib 110, which is cut off so as not to block the corner portion of the second side 42*b* and the third side 42*c* of the third manifold section 42. That is, the ink flowing in the third manifold section 42 in the first direction X is divided into two by the rib 110 having the notch section 111. Moreover, the notch section 111 may be provided in the corner portion separated from a center of the manifold 100 in the corner portion opposite to the liquid ejecting surface 20*a*. That is, the center of the manifold 100 is a center of the flow of the ink. In the embodiment, the notch section 111 is provided so as to expose the corner portion of the second side 42*b* and the third side 42*c* of the third manifold section 42 without blocking the corner portion thereof. Then, description will be given in detail later and it is possible to form the flow of the ink and to improve the discharge property of the air bubbles inside the manifold 100 along the corner portion separated from the center of the manifold 100 by the notch section 111 in a region in which the flow of the ink is likely to stagnate and the air bubbles are unlikely to flow, that is, in the corner portion opposite to the liquid ejecting surface 20*a*.

That is, in the embodiment, supply of the ink from the manifold 100 to the pressure generation chamber 12 is performed through the supply communication path 19 provided near the corner portion of the first side 42*a* and the fourth side 42*d* of the third manifold section 42.

Then, the center of the flow of the ink flowing in the first direction X inside the manifold 100 can be moved to a side with which the pressure generation chamber 12 communicates, that is, to the side of the corner portion of the first side 42*a* and the fourth side 42*d* by providing the rib 110. In the embodiment, since the notch section 111 is provided, the flow of the ink inside the manifold 100 is divided into two on both sides of the rib 110. At this time, if an entire opening of the manifold 100, that is, an area of the opening of the notch section 111 with respect to the opening in the cross sections in the first direction X and the second direction Y of the manifold 100 is decreased, much ink can flow on the side opposite to the notch section 111 of the rib 110, that is the side of the supply communication path 19 provided near the corner portion of the first side 42*a* and the fourth side 42*d* of the third manifold section 42. That is, it is possible to move the center of the flow of the ink to the side of the supply communication path 19.

Here, the flow of the ink flowing inside the manifold 100 will be described with reference to FIGS. 4A to 5. Moreover, FIGS. 4A and 5 are cross-sectional views of a main portion of the ink jet type recording head of a comparison, and FIG. 4B is a cross-sectional view of a main portion of the ink jet type recording head of the embodiment.

As illustrated in FIG. 4A, if the rib 110 is not provided inside the manifold 100, the center of the flow of the ink flowing inside the manifold 100 is $C_1$, on the other hand, as illustrated in FIG. 4B, if the rib 110 is provided inside the manifold 100 of the embodiment, a center $C_2$ of the flow of the ink flowing inside the manifold 100 moves to the side with which the pressure generation chamber 12 communicates rather than the center $C_1$ in which the rib 110 is not provided, that is, to the corner portion of the first side 42*a* and the fourth side 42*d*.

Therefore, it is possible to dispose the center $C_2$ of the flow of the ink flowing inside the manifold 100 on the side with which the pressure generation chamber 12 communicates by providing the rib 110 inside the manifold 100, the ink supplied to the pressure generation chamber 12 is closer to the ink of the center $C_2$ flowing inside the manifold 100, and it is possible to decrease the temperature gradient between the temperature of the ink flowing in the center $C_2$, that is, the temperature of the ink supplied through the inflow path 44 and the temperature of the ink supplied to the pressure generation chamber 12. That is, when supplying the ink that is warmed within the manifold 100, if the center of the flow of the ink that is warmed is $C_1$, a temperature difference occurs between the temperature of the center $C_1$ of the flow and a region separated from the center $C_1$, specifically, the temperature of the region with which the pressure generation chamber 12 communicates (increase in the temperature gradient). On the other hand, as illustrated in FIG. 4B, it is possible to decrease the temperature difference between the temperature of the center $C_2$ of the flow and the temperature of the region with which the pressure generation chamber 12 communicates by moving the center $C_2$ of the flow of the ink that is warmed to the side of the region with which the pressure generation chamber 12 communicates (decrease in the temperature gradient). That is, it is possible to supply the ink having a desired temperature, which circulates inside of the manifold 100 to the pressure generation chamber 12 in a state where the decrease in the temperature thereof is suppressed and since the ink can be ejected at a desired temperature, it is possible to suppress a deterioration in the ink ejection characteristics.

Furthermore, since the rib 110 does not remarkably reduce the volume of the manifold 100, it is possible to suppress an increase in a pressure loss and to suppress supply failure due to the increase of the pressure loss by lack of volume of the manifold 100, occurrence of crosstalk generated by moving the ink to the side of the manifold 100 by driving the piezoelectric actuator 300, or the like.

Furthermore, as the embodiment, it is possible to reinforce the case member 40 in which the space such as the third manifold section 42 is provided by the rib 110 and to suppress occurrence of distortion of the case member 40, and the like by providing the rib 110 in the manifold 100, specifically, on a line connecting diagonal corners of the third manifold section 42. In the embodiment, since the third manifold section 42 is provided that is open to the surface in which the communication plate 15 is bonded to the case member 40 and to the surface on the side in which the lid member 49 is bonded to the case member 40, specifically, there is a concern that the rigidity of the case member 40 may decrease, but it is possible to improve the rigidity of the case member 40 by providing the rib 110 in the case member 40. Therefore, it is possible to suppress defects in which other members are bonded in a state of being distorted and the like by suppressing occurrence of the distortion when handling the case member 40. Furthermore, also in a bonded body after bonding the communication plate 15 or the lid member 49 to the case member 40, it is possible to improve the rigidity in an entirety of the bonded body of the case member 40 and other members by providing the rib 110. Specifically, in the embodiment, it is possible to prevent the beam section 46 from being deformed or destroyed by a stress when bonding the communication plate 15 or the lid member 49 to the beam section 46 by improving the rigidity of the beam section 46 by the rib 110.

Furthermore, as illustrated in FIG. 5, if a rib 130 is formed along a side of the third manifold section 42, that is, if the rib 130 is formed by a protrusion section 131 that protrudes from the third side 42*c* to the fourth side 42*d*, and a protrusion section 132 that protrudes from the second side 42*b* to the first side 42*a*, the center $C_1$ of the ink flowing inside the manifold 100 can be moved to $C_3$ by moving the center $C_1$ on the side with which the pressure generation chamber 12 communicates, but since the ink does not flow along the corner portion of the second side 42*b* and the third side 42*c* of the manifold 100, air bubbles 200 stagnate and the air bubbles 200 grow and the like, and then the air bubbles 200 enter the pressure generation chamber 12 and the like at an unexpected timing, thereby there being a concern that ink ejection failure may occur.

On the other hand, as illustrated in FIG. 4B, since the notch section 111 is formed in the rib 110, the ink flows in the corner portion of the second side 42*b* and the third side 42*c* of the manifold 100. Therefore, even when the air bubbles 200 rise due to buoyancy, the air bubbles are discharged with the ink from the outflow path by the ink flowing in the corner portion of the second side 42*b* and the third side 42*c*. Specifically, the air bubbles 200 are likely to stagnate in the corner portion of the third side 42*c* and the second side 42*b*, that is, a corner portion separated from the center of the manifold 100, in which the flow of the ink is most likely to stagnate on the side opposite to the liquid ejecting surface 20*a*, that is on the Z2 side, but the notch section 111 exposes the corner portion, thereby it being possible to form the flow of the ink along the corner portion and to discharge the air bubbles to the outside through the outflow path 45.

Moreover, in the embodiment, one end 110*a* of the rib 110 is connected over the first side 42*a* and the third side 42*c*, and the other end 110*b* is connected to the fourth side 42*d*, but the rib 110 is not specifically limited to the embodiment. One end 110*a* of the rib 110 may be connected to at least one side of the first side 42*a* and the third side 42*c*, and the other end 110*b* may be connected to the other side of the first side 42*a* and the third side 42*c*, at least one side of the second side 42*b* and the fourth side 42*d*.

Here, modification examples of the rib 110 will be described with reference to FIGS. 6A to 10. Moreover, FIGS. 6A to 10 are cross-sectional views of a main portion of an ink jet type recording head illustrating modification examples of the rib.

Figure 6A:
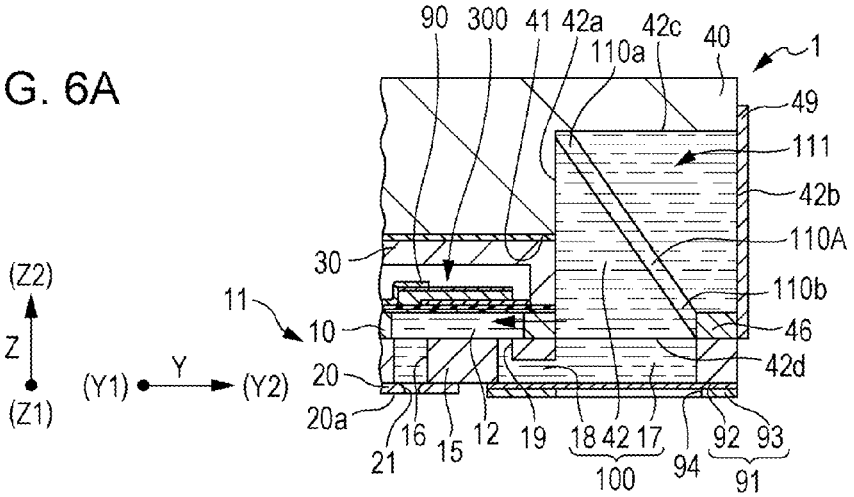
FIGS. 6A to 6C are cross-sectional views illustrating modification examples of a rib of the recording head according to the first embodiment.

As illustrated in FIG. 6A, one end 110*a* of a rib 110A is connected over a first side 42*a* and a third side 42*c*, and the other end 110*b* of the rib 110A is connected to a second side 42*b*. In the embodiment, the other end of the rib 110A is connected to a beam section 46 and the rigidity of the beam section 46 is improved by providing the rib 110A. Furthermore, since the rib 110A is provided with a notch section 111 that is formed by cutting off a corner portion of the third side 42*c* and the second side 42*b* of a third manifold section 42, stagnation of the ink is unlikely to occur and it is possible to improve the air bubble discharge property. Furthermore, since the ink flowing inside a manifold 100 is divided into two and a center of the flow of the ink moves to a side with which a pressure generation chamber 12 communicates by providing the rib 110A, it is possible to reduce a temperature difference between a temperature of the ink of the center of the flow supplied inside the manifold 100 and a temperature of the ink supplied inside the pressure generation chamber 12.

Figure 6B:
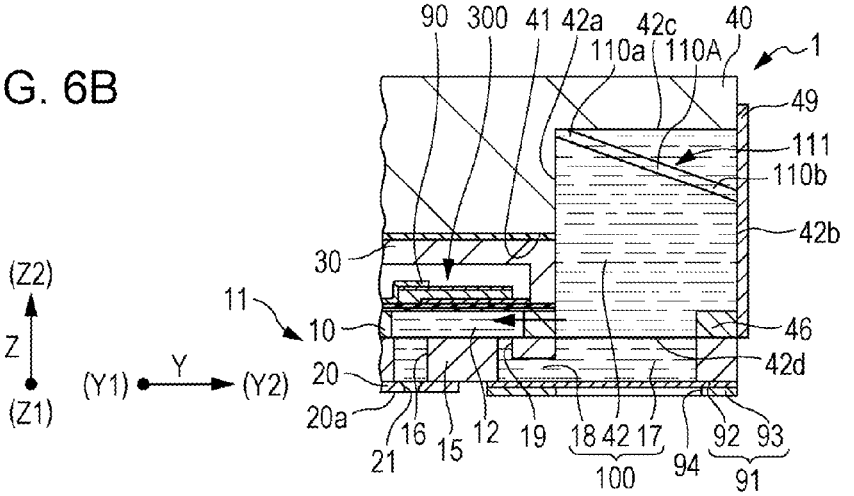

As illustrated in FIG. 6B, one end 110*a* of the rib 110A is connected over the first side 42*a* and the third side 42*c*, and the other end 110*b* of the rib 110A is connected to the second side 42*b*. In the embodiment, the other end of the rib 110A is not connected to the beam section 46. Also in such a configuration, it is possible to improve rigidity of a bonded body of a case member 40 and a lid member 49 by the rib 110A by bonding the lid member 49 to the other end of the rib 110A. Furthermore, since the rib 110A is provided with the notch section 111 that is formed by cutting off the corner portion of the third side 42*c* and the second side 42*b* of the third manifold section 42, stagnation of the ink is unlikely to occur and it is possible to improve the air bubble discharge property. Furthermore, since the ink flowing inside the manifold 100 is divided into two and the center of the flow of the ink moves to the side with which the pressure generation chamber 12 communicates by providing the rib 110A, it is possible to reduce the temperature difference between the temperature of the ink of the center of the flow supplied inside the manifold 100 and the temperature of the ink supplied inside the pressure generation chamber 12.

Figure 6C:
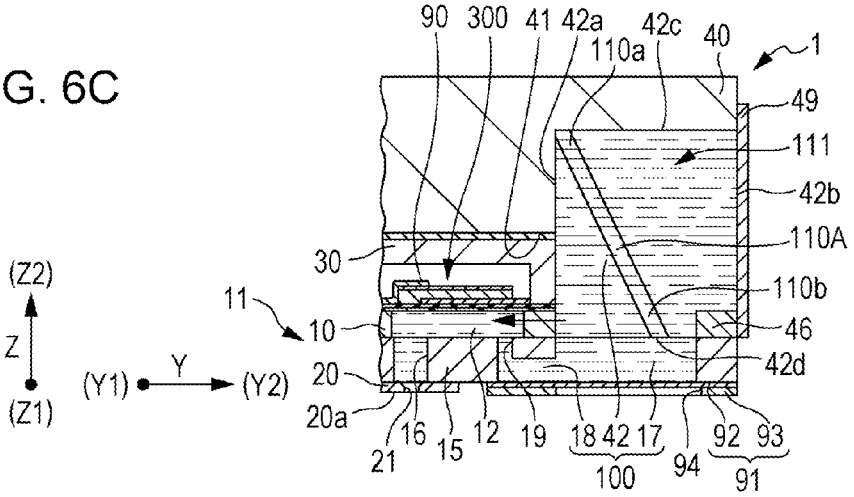

As illustrated in FIG. 6C, one end 110*a* of the rib 110A is connected over the first side 42*a* and the third side 42*c*, and the other end 110*b* of the rib 110A is connected to a fourth side 42*d*. In the embodiment, the other end of the rib 110A is not connected to the beam section 46. Also in such a configuration, since the rib 110A is provided with the notch section 111 that is formed by cutting off the corner portion of the third side 42*c* and the second side 42*b* of the third manifold section 42, stagnation of the ink is unlikely to occur and it is possible to improve the air bubble discharge property. Furthermore, since the ink flowing inside the manifold 100 is divided into two and the center of the flow of the ink moves to the side with which the pressure generation chamber 12 communicates by providing the rib 110A, it is possible to reduce the temperature difference between the temperature of the ink of the center of the flow supplied inside the manifold 100 and the temperature of the ink supplied inside the pressure generation chamber 12.

Furthermore, one end of the rib may be connected only to a first side 42*a* or a third side 42*c*. For example, FIGS. 7A to 8B illustrate a configuration in which one end 110*a* of a rib 110B is connected only to the first side 42*a*, and FIGS. 9A to 10 illustrate a configuration in which one end 110*a* of a rib 110C is connected only to the third side 42*c*.

Figure 7A:
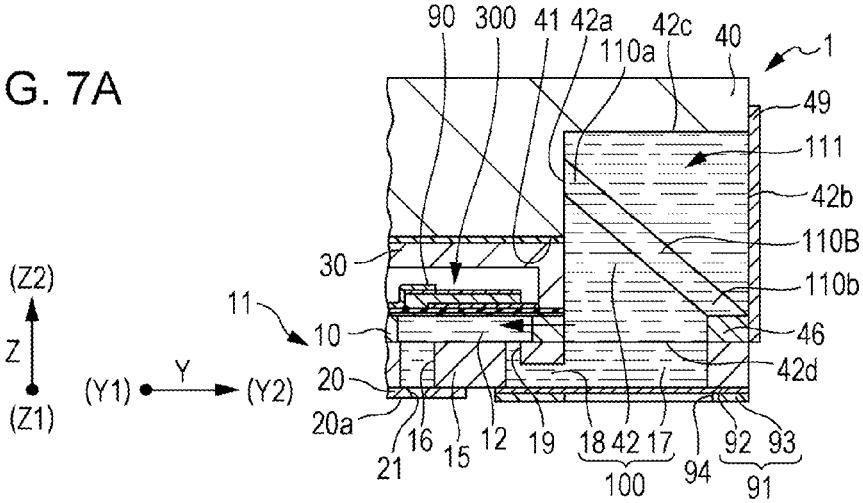
FIGS. 7A to 7C are cross-sectional views illustrating modification examples of the rib of the recording head according to the first embodiment.

Specifically, as illustrated in FIG. 7A, one end 110*a* of the rib 110B is connected to the first side 42*a* and the other end 110*b* of the rib 110B is connected to a fourth side 42*d*, in the embodiment, to a beam section 46. In such a configuration, it is possible to improve rigidity of a case member 40 by the rib 110B and to improve rigidity of a bonded body that is formed by bonding a lid member 49 or a communication plate 15 to the case member 40. Furthermore, since the rib 110B is provided with a notch section 111 that exposes a corner portion of the third side 42*c* and a second side 42*b*, and a corner portion of the third side 42*c* and the first side 42*a*, a corner portion of the first side 42*a* and the third side 42*c*, and a corner portion of the second side 42*b* and the third side 42*c* are not blocked by the notch section 111 in the flowing direction of the ink. Therefore, even if the air bubbles rise due to buoyancy, it is possible to suppress stagnation of the air bubbles in the corner portion of the first side 42*a* and the third side 42*c*, and the corner portion of the second side 42*b* and the third side 42*c*, which are upper sides in a vertical direction. Furthermore, since the ink flowing inside a manifold 100 is divided into two and a center of the flow of the ink moves to a side with which a pressure generation chamber 12 communicates by providing the rib 110B, it is possible to reduce a temperature difference between a temperature of the ink of the center of the flow supplied inside the manifold 100 and a temperature of the ink supplied inside the pressure generation chamber 12.

Figure 7B:
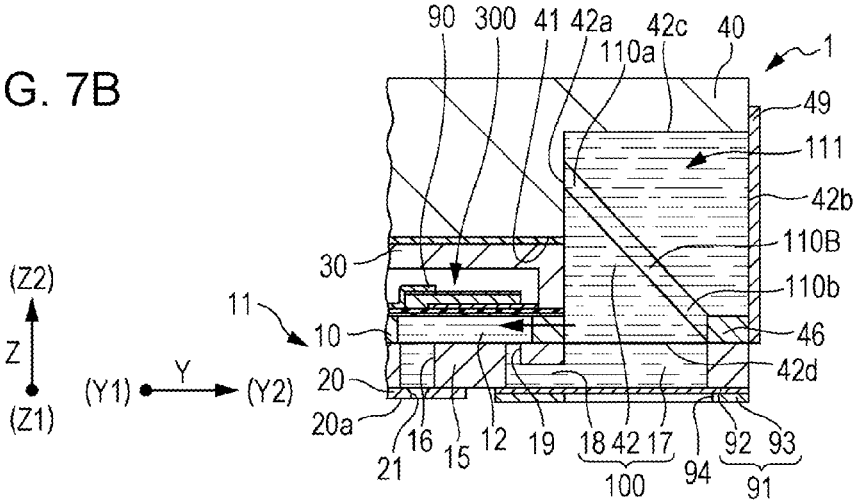

Furthermore, as illustrated in FIG. 7B, one end 110*a* of the rib 110B is connected to the first side 42*a* and the other end 110*b* of the rib 110B is connected to a third side 42*c*, in the embodiment, to the beam section 46. In such a configuration, it is possible to improve rigidity of the case member 40 by the rib 110B and to improve the rigidity of the bonded body that is formed by bonding the lid member 49 or the communication plate 15 to the case member 40. Furthermore, since the rib 110B is provided with the notch section 111 on the side of the third side 42*c*, the corner portion of the first side 42*a* and the third side 42*c* of the third manifold section 42, and the corner portion of the second side 42*b* and the third side 42*c* are not blocked by the notch section 111 in the flowing direction of the ink. Therefore, even if the air bubbles rise due to buoyancy, it is possible to suppress stagnation of the air bubbles in the corner portion of the first side 42*a* and the third side 42*c*, and the corner portion of the second side 42*b* and the third side 42*c*, which are upper sides in a vertical direction. Furthermore, since the ink flowing inside the manifold 100 is divided into two and the center of the flow of the ink moves to the side with which the pressure generation chamber 12 communicates by providing the rib 110B, it is possible to reduce the temperature difference between the temperature of the ink of the center of the flow supplied inside the manifold 100 and the temperature of the ink supplied inside the pressure generation chamber 12.

Figure 7C:
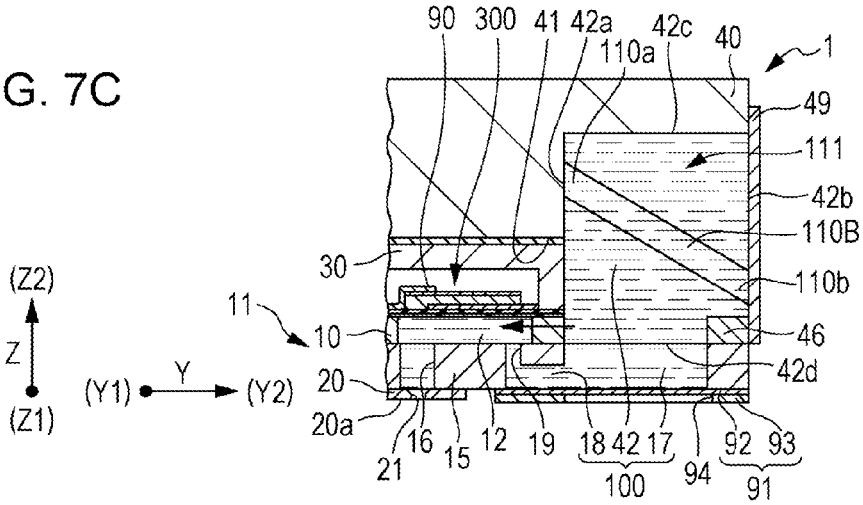

Furthermore, as illustrated in FIG. 7C, one end 110*a* of the rib 110B is connected to the first side 42*a* and the other end 110*b* of the rib 110B is connected to the second side 42*b*. However, the other end of the rib 110B is not connected to the beam section 46. In such a configuration, it is possible to improve the rigidity of the bonded body that is formed by bonding the lid member 49 to the case member 40 by bonding the lid member 49 to the other end of the rib 110B. Furthermore, since the rib 110B is provided with the notch section 111 that exposes the corner portion of the third side 42*c* and the second side 42*b*, and the corner portion of the third side 42*c* and the first side 42*a*, the corner portion of the first side 42*a* and the third side 42*c*, and the corner portion of the second side 42*b* and the third side 42*c* are not blocked by the notch section 111 in the flowing direction of the ink. Therefore, even if the air bubbles rise due to buoyancy, it is possible to suppress stagnation of the air bubbles in the corner portion of the first side 42*a* and the third side 42*c*, and the corner portion of the second side 42*b* and the third side 42*c*, which are the upper sides in the vertical direction. Furthermore, since the ink flowing inside the manifold 100 is divided into two and the center of the flow of the ink moves to the side with which the pressure generation chamber 12 communicates by providing the rib 110B, it is possible to reduce the temperature difference between the temperature of the ink of the center of the flow supplied inside the manifold 100 and the temperature of the ink supplied inside the pressure generation chamber 12.

Figure 8A:
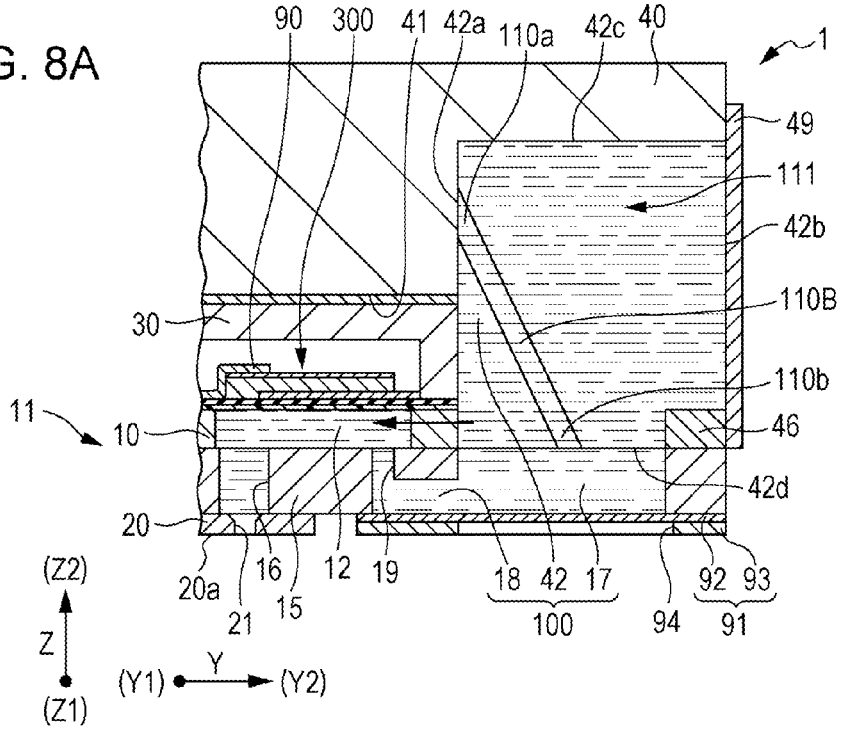
FIGS. 8A and 8B are cross-sectional views illustrating modification examples of the rib of the recording head according to the first embodiment.
Figure 9A:
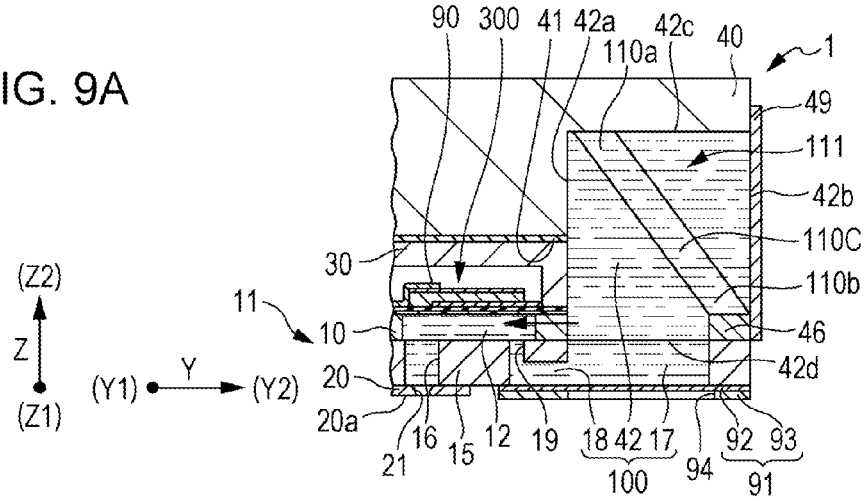
FIGS. 9A to 9C are cross-sectional views illustrating modification examples of the rib according to the first embodiment.

Furthermore, as illustrated in FIG. 8A, one end 110*a* of the rib 110B is connected to the first side 42*a* and the other end 110*b* of the rib 110B is connected to the fourth side 42*d*. However, the other end of the rib 110B is not connected to the beam section 46. Also in such a configuration, since the rib 110B is provided with the notch section 111 that exposes the corner portion of the third side 42*c* and the second side 42*b*, and the corner portion of the third side 42*c* and the first side 42*a*, the corner portion of the first side 42*a* and the third side 42*c*, and the corner portion of the second side 42*b* and the third side 42*c* are not blocked by the notch section 111 in the flowing direction of the ink. Therefore, even if the air bubbles rise due to buoyancy, it is possible to suppress stagnation of the air bubbles in the corner portion of the first side 42*a* and the third side 42*c*, and the corner portion of the second side 42*b* and the third side 42*c*, which are the upper sides in the vertical direction. Furthermore, since the ink flowing inside the manifold 100 is divided into two and the center of the flow of the ink moves to the side with which the pressure generation chamber 12 communicates by providing the rib 110B, it is possible to reduce the temperature difference between the temperature of the ink of the center of the flow supplied inside the manifold 100 and the temperature of the ink supplied inside the pressure generation chamber 12.

Figure 8B:
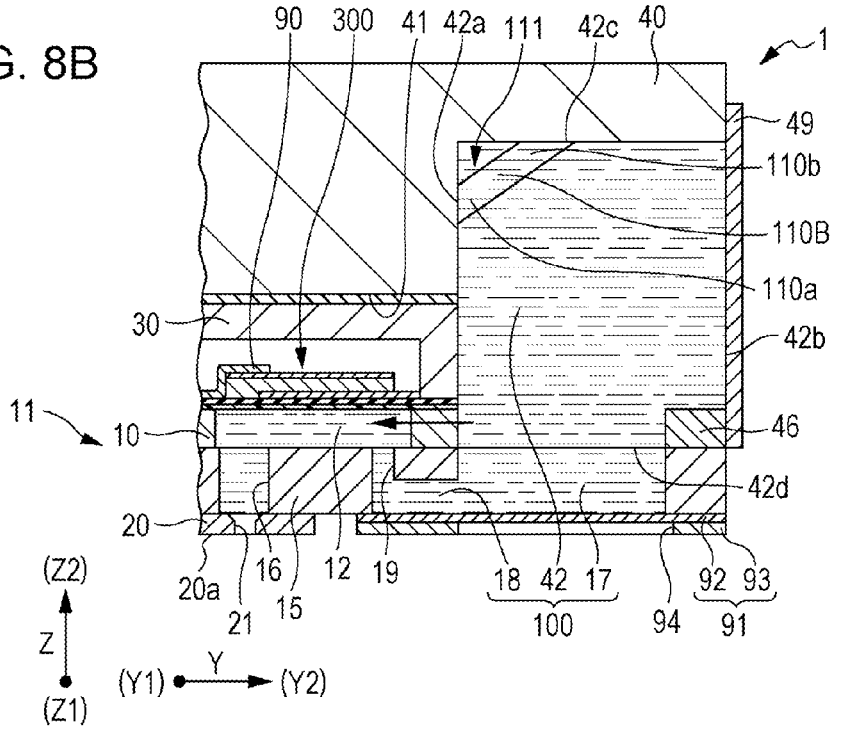

Furthermore, as illustrated in FIG. 8B, one end 110*a* of the rib 110B is connected to the first side 42*a* and the other end 110*b* of the rib 110B is connected to the third side 42*c*. That is, both ends of the rib 110B of FIG. 8B are continuously formed from the case member 40. In such a configuration, the rigidity of the case member 40 is improved by providing the rib 110B. Furthermore, since the rib 110B is provided with the notch section 111 that exposes the corner portion of the third side 42*c* and the first side 42*a*, the corner portion of the first side 42*a* and the third side 42*c*, and the corner portion of the second side 42*b* and the third side 42*c* are not blocked by the notch section 111 in the flowing direction of the ink. Therefore, even if the air bubbles rise due to buoyancy, it is possible to suppress stagnation of the air bubbles in the corner portion of the first side 42*a* and the third side 42*c*, and the corner portion of the second side 42*b* and the third side 42*c*, which are the upper sides in the vertical direction. Furthermore, since the ink flowing inside the manifold 100 is divided into two and the center of the flow of the ink moves to the side with which the pressure generation chamber 12 communicates by providing the rib 110B, it is possible to reduce the temperature difference between the temperature of the ink of the center of the flow supplied inside the manifold 100 and the temperature of the ink supplied inside the pressure generation chamber 12.

Furthermore, as illustrated in FIG. 9A, one end 110*a* of the rib 110C is connected to a third side 42*c* and the other end 110*b* of the rib 110C is connected to a fourth side 42*d*, in the embodiment, to a beam section 46. In such a configuration, it is possible to improve rigidity of a case member 40 by the rib 110C and to improve rigidity of a bonded body that is formed by bonding a lid member 49 or a communication plate 15 to the case member 40. Furthermore, since the rib 110C is provided with a notch section 111 that exposes a corner portion of the third side 42*c* and a second side 42*b*, a corner portion of the first side 42*a* and the third side 42*c*, and a corner portion of the second side 42*b* and the third side 42*c* are not blocked by the notch section 111 in the flowing direction of the ink. Therefore, even if the air bubbles rise due to buoyancy, it is possible to suppress stagnation of the air bubbles in the corner portion of the first side 42*a* and the third side 42*c*, and the corner portion of the second side 42*b* and the third side 42*c*, which are upper sides in the vertical direction. Furthermore, since the ink flowing inside a manifold 100 is divided into two and a center of the flow of the ink moves to a side with which a pressure generation chamber 12 communicates by providing the rib 110C, it is possible to reduce a temperature difference between a temperature of the ink of the center of the flow supplied inside the manifold 100 and a temperature of the ink supplied inside the pressure generation chamber 12.

Figure 9B:
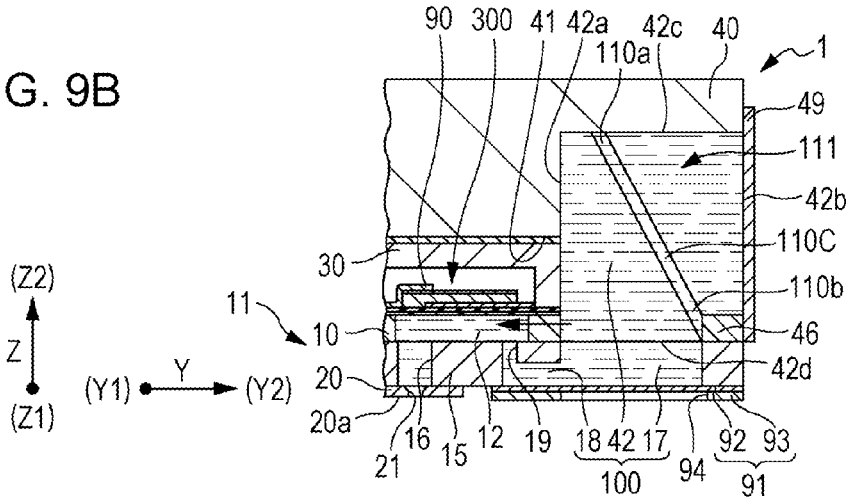
Figure 10:
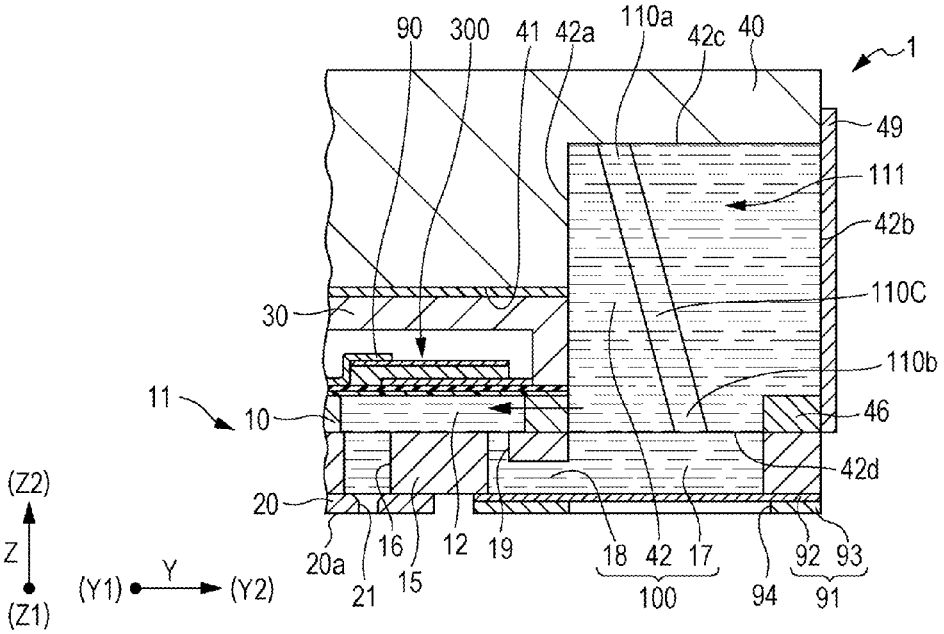
FIG. 10 is a cross-sectional view illustrating a modification example of the rib according to the first embodiment.

Furthermore, as illustrated in FIG. 9B, one end 110*a* of the rib 110C is connected to the third side 42*c* and the other end 110*b* of the rib 110C is connected to the second side 42*b*, in the embodiment, to the beam section 46. In such a configuration, it is possible to improve the rigidity of the case member 40 by the rib 110C and to improve rigidity of the bonded body that is formed by bonding the lid member 49 or the communication plate 15 to the case member 40. Furthermore, since the rib 110C is provided with the notch section 111 that exposes the corner portion of the third side 42*c* and the second side 42*b*, the corner portion of the first side 42*a* and the third side 42*c*, and the corner portion of the second side 42*b* and the third side 42*c* are not blocked by the notch section 111 in the flowing direction of the ink. Therefore, even if the air bubbles rise due to buoyancy, it is possible to suppress stagnation of the air bubbles in the corner portion of the first side 42*a* and the third side 42*c*, and the corner portion of the second side 42*b* and the third side 42*c*, which are upper sides in the vertical direction. Furthermore, since the ink flowing inside the manifold 100 is divided into two and the center of the flow of the ink moves to the side with which the pressure generation chamber 12 communicates by providing the rib 110C, it is possible to reduce the temperature difference between the temperature of the ink of the center of the flow supplied inside the manifold 100 and the temperature of the ink supplied inside the pressure generation chamber 12.

Figure 9C:
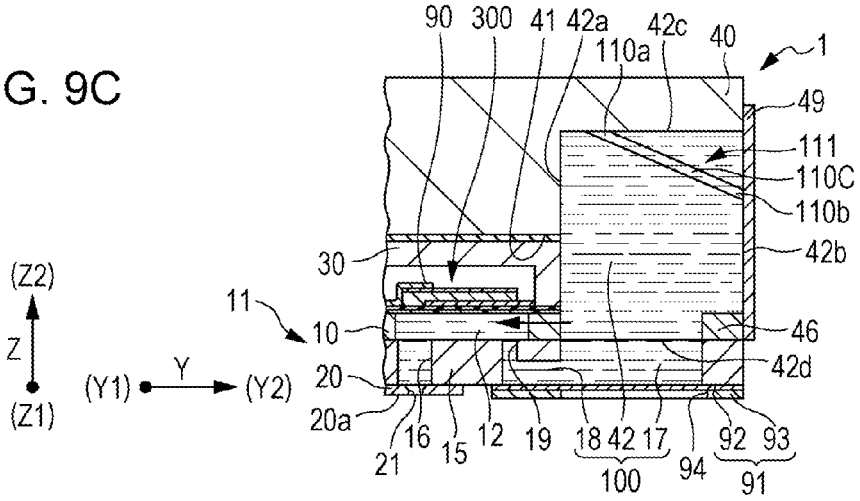

Furthermore, as illustrated in FIG. 9C, one end 110*a* of the rib 110C is connected to the third side 42*c* and the other end 110*b* of the rib 110C is connected to the second side 42*b*. However, the other end of the rib 110C is not connected to the beam section 46. In such a configuration, it is possible to improve the rigidity of the bonded body that is formed by bonding the lid member 49 to the case member 40 by bonding the lid member 49 to the other end of the rib 110C. Furthermore, since the rib 110C is provided with the notch section 111 that exposes the corner portion of the third side 42*c* and the second side 42*b*, the corner portion of the first side 42*a* and the third side 42*c*, and the corner portion of the second side 42*b* and the third side 42*c* are not blocked by the notch section 111 in the flowing direction of the ink. Therefore, even if the air bubbles rise due to buoyancy, it is possible to suppress stagnation of the air bubbles in the corner portion of the first side 42*a* and the third side 42*c*, and the corner portion of the second side 42*b* and the third side 42*c*, which are upper sides in the vertical direction. Furthermore, since the ink flowing inside the manifold 100 is divided into two and the center of the flow of the ink moves to the side with which the pressure generation chamber 12 communicates by providing the rib 110C, it is possible to reduce the temperature difference between the temperature of the ink of the center of the flow supplied inside the manifold 100 and the temperature of the ink supplied inside the pressure generation chamber 12.

Furthermore, as illustrated in FIG. 10, one end 110*a* of the rib 110C is connected to the third side 42*c* and the other end 110*b* of the rib 110C is connected to the fourth side 42*d*. However, the other end of the rib 110C is not connected to the beam section 46. Also in such a configuration, since the rib 110C is provided with the notch section 111 that exposes the corner portion of the third side 42*c* and the second side 42*b*, the corner portion of the first side 42*a* and the third side 42*c*, and the corner portion of the second side 42*b* and the third side 42*c* are not blocked by the notch section 111 in the flowing direction of the ink. Therefore, even if the air bubbles rise due to buoyancy, it is possible to suppress stagnation of the air bubbles in the corner portion of the first side 42*a* and the third side 42*c*, and the corner portion of the second side 42*b* and the third side 42*c*, which are upper sides in the vertical direction. Furthermore, since the ink flowing inside the manifold 100 is divided into two and the center of the flow of the ink moves to the side with which the pressure generation chamber 12 communicates by providing the rib 110C, it is possible to reduce the temperature difference between the temperature of the ink of the center of the flow supplied inside the manifold 100 and the temperature of the ink supplied inside the pressure generation chamber 12.

Other Embodiments

The foregoing has described one embodiment of the invention, but a basic configuration of the invention is not limited to the above description.

For example, in the above one embodiment, the ribs 110 to 110C are provided by being inclined with respect to the third direction Z, but are not specifically limited to the embodiment. The ribs 110 to 110C may be provided parallel to the third direction Z and may be provided parallel to the second direction Y. Furthermore, since the other end of the ribs 110 to 110C may be connected to the other side of the first side 42*a* and the third side 42*c*, and at least one side of the second side 42*b* and the fourth side 42*d*, for example, the other end may be connected over the first side 42*a* and the fourth side 42*d*, that is, to the corner portion, may be connected to the corner portion of the second side 42*b* and the third side 42*c*, and may be connected to the corner portion of the third side 42*c* and the fourth side 42*d*.

Furthermore, in the above embodiment, the ribs 110 to 110C are provided inside the third manifold section 42, but the ribs 110 to 110C may be formed over the manifold 100 in a direction intersecting the first direction X in which the ink flows inside the manifold 100. Therefore, the other end 110*b* of the ribs 110 to 110C may be extended to any of four sides of the first manifold section 17 of the communication plate 15. Furthermore, the other end 110*b* of the ribs 110 to 110C may be extended to any of four sides of the second manifold section 18.

Figure 11:
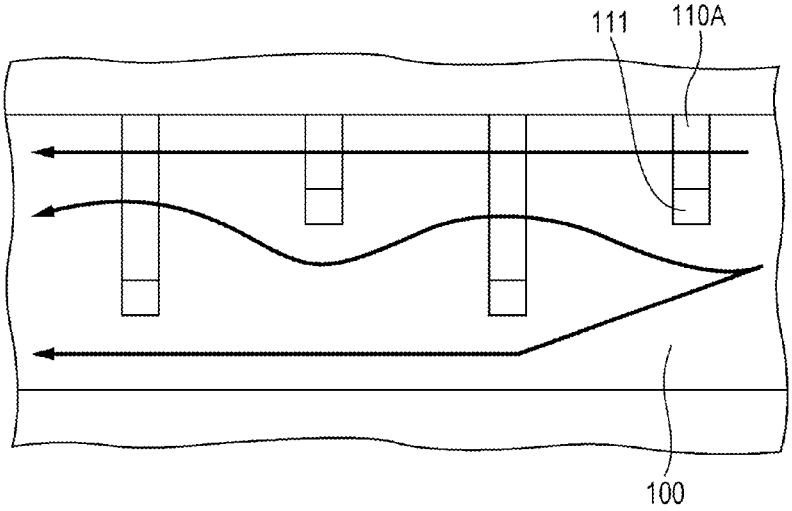
FIG. 11 is a plan view illustrating a modification example of the rib according to one embodiment.

Furthermore, in the above one embodiment, the plurality of ribs 110 to 110C provided in the manifold 100 are provided in the same position as each other, that is, the positions of the ribs 110 to 110C in the second direction Y and the third direction Z are the same as each other, but are not specifically limited to the embodiment. For example, in the plurality of ribs 110 to 110C provided in one manifold 100, the position to which one end 110*a* of each of the ribs 110 to 110C is connected and the position to which the other end 110*b* is connected may be different arrangements. Specifically, for example, as illustrated in FIG. 11, the positions of the other ends of the ribs 110A illustrated in FIG. 6B described above are disposed in different positions in the third direction Z. Therefore, since the flow of the ink inside the manifold 100 can be made to meander according to the rib 110A, it is possible to reduce the temperature gradient of the ink in the entirety of the manifold 100 by agitating the ink inside the manifold 100. Moreover, a modification example of FIG. 6B is illustrated in FIG. 11, but the configuration is not specifically limited to the example, and the configuration can be applied to any of the ribs 110 to 110C described above. Furthermore, the ribs 110 to 110C may be combined.

Furthermore, in the above first embodiment, the configuration is given in which the ink flowing from the inflow path 44 into the manifold 100 is discharged through the outflow path 45, but the configuration is not specifically limited to the embodiment. The ink that flows from the inflow path 44 into the manifold 100 passes through the pressure generation chamber 12 or the nozzle communication path 16 and then may be discharged from the outflow path 45. That is, a first manifold 100A for causing the ink to flow into the pressure generation chamber 12 or the nozzle communication path 16 and a second manifold 100B for causing the ink to flow from the pressure generation chamber 12 or the nozzle communication path 16 are provided, and the inflow path 44 may communicate with the first manifold 100A and the outflow path 45 may communicate with the second manifold 100B.

Furthermore, the outflow path 45 may not be provided. That is, even if the ink flows only from the inflow path 44 into the manifold 100 and even if only the ribs 110 to 110C are provided, it is possible to suppress the temperature gradient inside the manifold 100 and to improve the air bubble discharge property, thereby the rigidity of the case member 40 or the bonded body in which other members are bonded to the case member 40 being able to be improved.

Furthermore, for example, in above one embodiment, the configuration of the ink jet type recording head 1 having the communication plate 15 and the configuration in which the compliance substrate 91 is disposed on the surface of the communication plate 15 on the Z1 side are exemplified, but the presence or absence of the communication plate 15 is not specifically limited to the embodiment, and the position of the compliance substrate 91 is also not specifically limited to the embodiment. For example, the compliance substrate 91 may be provided on the side of a wall surface with respect to the manifold 100 in the second direction Y and may be provided on the Z2 side in the third direction Z.

Furthermore, in above one embodiment, the description is given in which the piezoelectric actuator 300 is used as the pressure generation unit that generates the pressure change in the pressure generation chamber 12, but, for example, the piezoelectric actuator 300 may be a thin film type that is formed by a deposition method and a lithography method, and may be a thick film type that is formed by a method such as adhering a green sheet. Furthermore, it is also possible to use a piezoelectric actuator of a longitudinal vibration type that expands and contracts an electric material and an electrode forming material by alternately laminating the electric material and the electrode forming material in the axial direction. Furthermore, as the pressure generation unit, it is possible to use a unit in which a heating element is disposed inside a pressure generation chamber and liquid droplets are ejected from a nozzle opening by bubbles generated by heating of the heating element, or to use a so-called electrostatic actuator in which static electricity is generated between the vibration plate and the electrode and a vibration plate is deformed by an electrostatic force, and liquid droplets are ejected from a nozzle opening.

Figure 12:
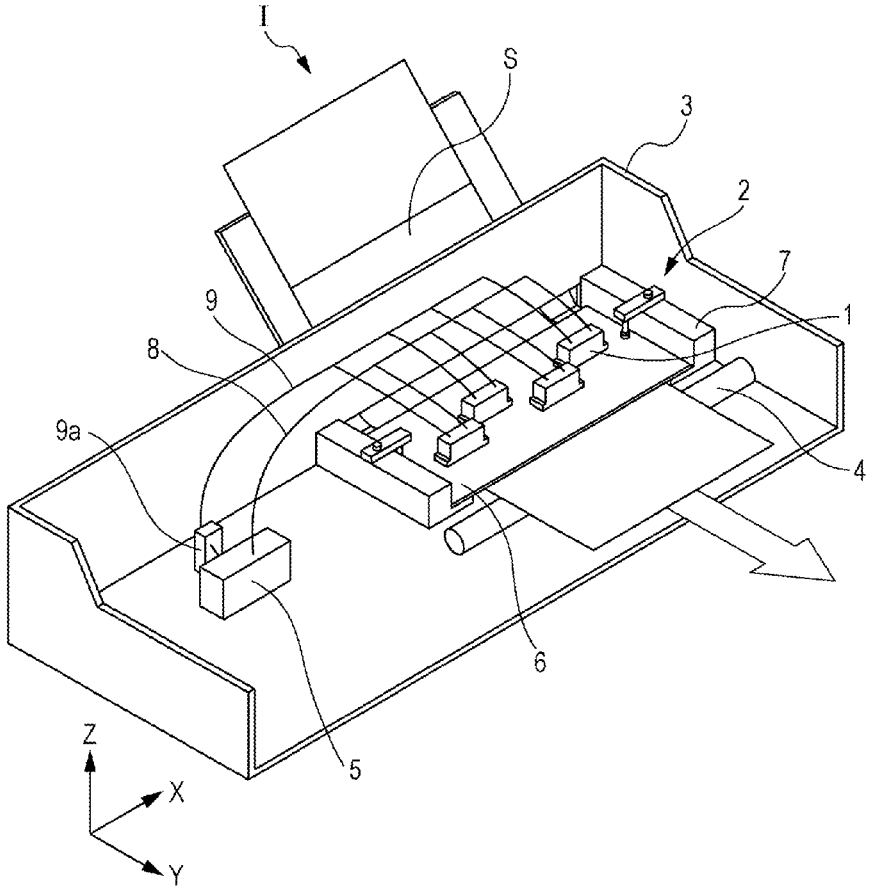
FIG. 12 is a view illustrating a schematic configuration of a recording apparatus according to one embodiment.

Furthermore, the ink jet type recording head 1 described above is configured of a part of an ink jet type recording head unit and is mounted on an ink jet type recording apparatus. FIG. 12 is a schematic view illustrating an example of the ink jet type recording apparatus.

An ink jet type recording apparatus I of the embodiment is an ink jet type recording apparatus of a so-called line type that performs printing on an ejection medium by fixing the ink jet type recording head 1 to an apparatus body and by transporting the ejection medium such as a recording sheet in a direction orthogonal to an arrangement direction of the nozzle openings 21, that is, the second direction Y.

Specifically, as illustrated in FIG. 12, the ink jet type recording apparatus I includes an ink jet type recording head unit 2 having the ink jet type recording head 1, an apparatus body 3, a roller 4 feeding an ejection medium S such as paper, and the liquid storage unit 5.

The ink jet type recording head unit 2 (hereinafter, referred to as the head unit 2) includes a plurality of ink jet type recording heads 1 and a planar base plate 6 holding the plurality of ink jet type recording heads 1. The head unit 2 is fixed to the apparatus body 3 through a frame member 7 mounted on the base plate 6.

Furthermore, the apparatus body 3 is provided with the roller 4. The roller 4 transports the ejection medium S such as paper that is fed to the apparatus body 3 and allows the ejection medium S to pass through the liquid ejecting surface 20*a* of the ink jet type recording head 1 when facing each other.

Furthermore, the liquid storage unit 5 that is fixed to the apparatus body 3 and stores the ink is connected to each ink jet type recording head 1 through a supply pipe 8 and a recovery pipe 9 such as a flexible tube. The ink is supplied from the liquid storage unit 5 to the inflow path 44 of each ink jet type recording head 1 through the supply pipe 8 and the ink that is not ejected from the ink jet type recording head 1 is collected from the outflow path 45 by the liquid storage unit 5 through the recovery pipe 9. Furthermore, a pump 9*a* is provided in the middle of the recovery pipe 9 and the ink from the liquid storage unit 5 circulates by passing through the inflow path, the manifold 100, and the outflow path inside the ink jet type recording head 1 due to a pressure of the pump 9*a*. Furthermore, although not specifically illustrated, a heating unit such as a heater heating the stored ink is provided in the liquid storage unit 5. Of course, the heating unit may be provided in the supply pipe 8 or the ink jet type recording head 1.

In such an ink jet type recording apparatus I, the ejection medium S is transported by the roller 4 in the transportation direction, the ink is ejected by the ink jet type recording head 1 of the head unit 2, and ink droplets are landed onto the ejection medium, thereby an image and the like being printed.

Figure 13:
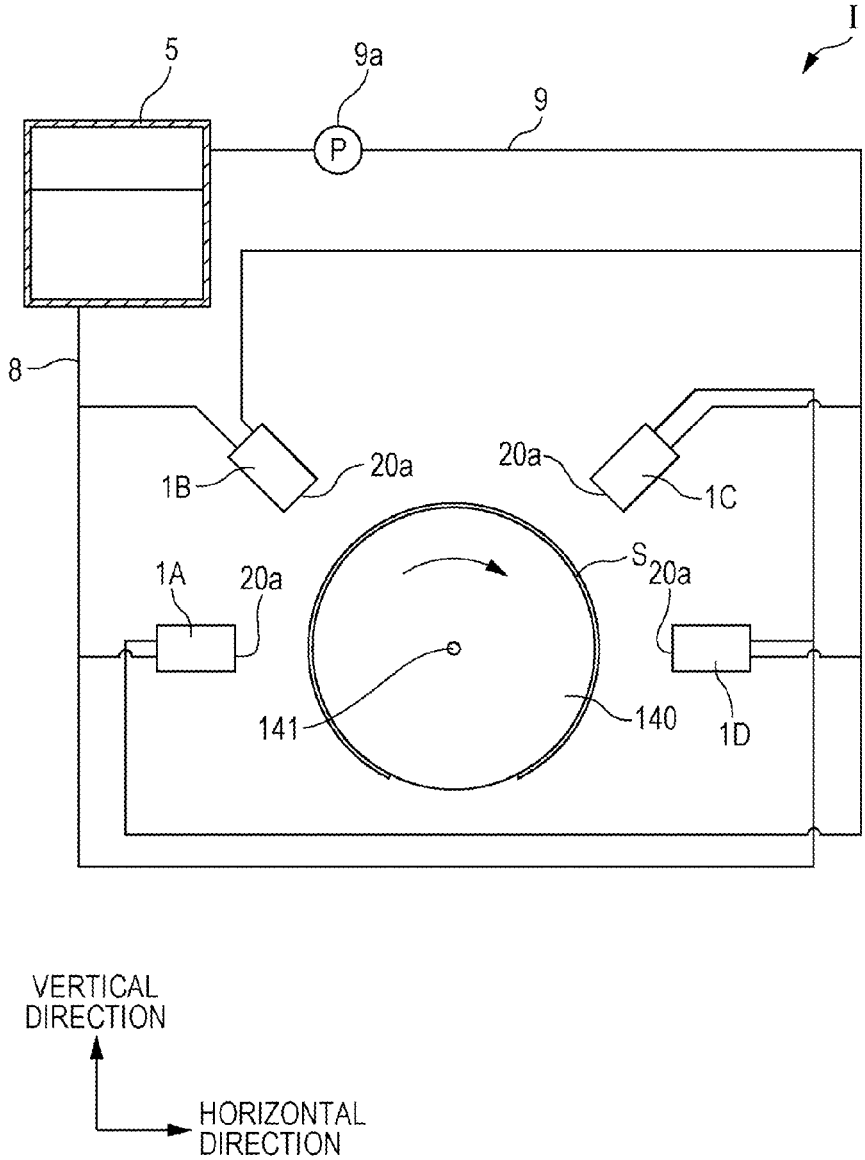
FIG. 13 is a view illustrating a schematic configuration of a recording apparatus according to one embodiment.

Furthermore, in the above embodiment, in the plurality of ink jet type recording heads 1, the liquid ejecting surfaces 20*a* are set to be matched in the same direction, that is, in the third direction Z between the plurality of ink jet type recording heads 1 and are arranged so as to eject the ink droplets to the lower side in the vertical direction, but the configuration is not specifically limited to the embodiment, and the liquid ejecting surfaces 20*a* of the ink jet type recording head 1 may be disposed in a direction in which surface directions thereof are orthogonal to each other. Here, such an example is illustrated in FIG. 13.

As illustrated in the view, the ink jet type recording apparatus I includes a support member 140 that has a cylindrical shape, a plurality of ink jet type recording heads 1A to 1D that are disposed such that liquid ejecting surfaces thereof ejecting the ink face the support member 140, and a liquid storage unit 5 in which the ink commonly supplying the ink jet type recording heads 1A to 1D is stored.

The support member 140 supports a side of a surface opposite to the surface of the paper or the ejection medium S such as the recording sheet that is transported by a transport unit (not illustrated), on which the ink droplets are landed. A holding method of the ejection medium S by the support member 140 is not specifically limited, but, for example, a method in which the surface opposite to the landing surface of the ejection medium S is sucked and held on the surface of the support member 140 may be exemplified. Furthermore, as another holding method, for example, a method in which an outer peripheral surface of the ejection medium S may be charged and the surface be sucked to the support member 140 by an action of dielectric polarization may be exemplified. Of course, a pressing roller and the like supporting the ejection medium S may be provided between the surface of the support member 140 and the ejection medium S.

Furthermore, the support member 140 is pivotally supported on a rotation shaft 141 so as to rotate in a circumferential direction. Moreover, the support member 140 is driven to be rotated by a driving unit such as a driving motor (not illustrated).

The plurality of ink jet type recording heads 1A to 1D are disposed such that the liquid ejecting surfaces 20*a* facing the surface of the ejection medium S supported on the support member 140, on which the ink droplets are landed are disposed at different installation angles, that is, surface directions of the liquid ejecting surfaces 20*a* intersect each other.

Specifically, in the embodiment, four ink jet type recording heads, that is, a first ink jet type recording head 1A, a second ink jet type recording head 1B, a third ink jet type recording head 1C, and a fourth ink jet type recording head 1D, are provided around the support member 140. Then, the third direction Z is not matched between the four ink jet type recording heads 1A to 1D. In the first ink jet type recording head 1A, the liquid ejecting surface 20*a* is disposed in the horizontal direction orthogonal to the vertical direction. That is, the liquid ejecting surface 20*a* of the first ink jet type recording head 1A is disposed such that the surface direction is the vertical direction. On the other hand, in the second ink jet type recording head 1B, the liquid ejecting surface 20*a* is disposed such that the surface direction faces the support member 140 at an inclined angle with respect to the vertical direction, for example, at 45 degrees. Furthermore, in the third ink jet type recording head 1C, the liquid ejecting surface 20*a* is disposed such that the surface direction faces the support member 140 at an inclined angle with respect to the vertical direction, for example, at 45 degrees. In addition, in the second ink jet type recording head 1B and the third ink jet type recording head 1C, the liquid ejecting surface 20*a* is disposed at a different angle, in the embodiment, for example, at a different angle by 90 degrees. Furthermore, in the fourth ink jet type recording head 1D, the liquid ejecting surface 20*a* is disposed in the horizontal direction orthogonal to the vertical direction. Moreover, the first ink jet type recording head 1A and the fourth ink jet type recording head 1D face each other at an angle of 180 degrees with respect to the support member 140. As described above, in the first ink jet type recording head 1A and the fourth ink jet type recording head 1D, the surface directions of the liquid ejecting surfaces 20*a* are the same vertical direction as each other and do not intersect each other, but the first ink jet type recording head 1A and the fourth ink jet type recording head 1D intersect the surface directions of the liquid ejecting surfaces 20*a* of other ink jet type recording heads 1B and 1C.

Furthermore, the liquid storage unit 5 is connected to each of the ink jet type recording heads 1A to 1D through the supply pipe 8 and the recovery pipe 9 such as flexible tubes. The ink supplied from the liquid storage unit 5 to the inflow path 44 of each of the ink jet type recording heads 1A to 1D through the supply pipe 8 and the ink that is not ejected by the ink jet type recording heads 1A to 1D is collected from the outflow path 45 to the liquid storage unit 5 through the recovery pipe 9. Furthermore, the pump 9*a* is provided in the middle of the recovery pipe 9 and the ink from the liquid storage unit 5 circulates by passing through the inflow path, the manifold 100, and the outflow path inside the ink jet type recording head 1 due to the pressure of the pump 9*a*. Furthermore, although not specifically illustrated, a heating unit such as a heater heating the stored ink is provided in the liquid storage unit 5. Of course, the heating unit may be provided in the supply pipe 8 or the ink jet type recording heads 1A to 1D.

Cross-sectional views of a main portion of the first ink jet type recording head 1A and the second ink jet type recording head 1B that are disposed as described above are illustrated in FIGS. 14A and 14B.

Figure 14A:
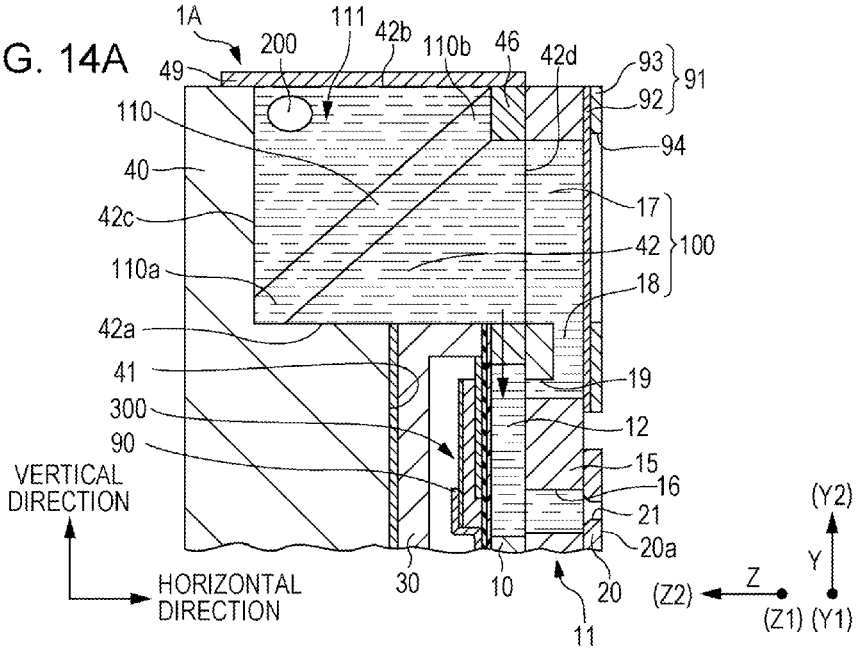
FIGS. 14A and 14B are cross-sectional views illustrating a flow of a liquid inside a recording head according to one embodiment.

As illustrated in FIG. 14A, the manifold 100 of the first ink jet type recording head 1A is provided by being inclined according to the angle of the liquid ejecting surface 20*a*. At this time, since the corner portion of the third side 42*c* and the second side 42*b* of the manifold 100 is disposed on the upper side in the vertical direction, but the notch section 111 exposing the corner portion of the third side 42*c* and the second side 42*b* is provided in the rib 110 of the first embodiment described above, the air bubbles 200 move to the upper side in the vertical direction due to buoyancy and it is possible to discharge the air bubbles 200 passing through the notch section 111.

Figure 14B:
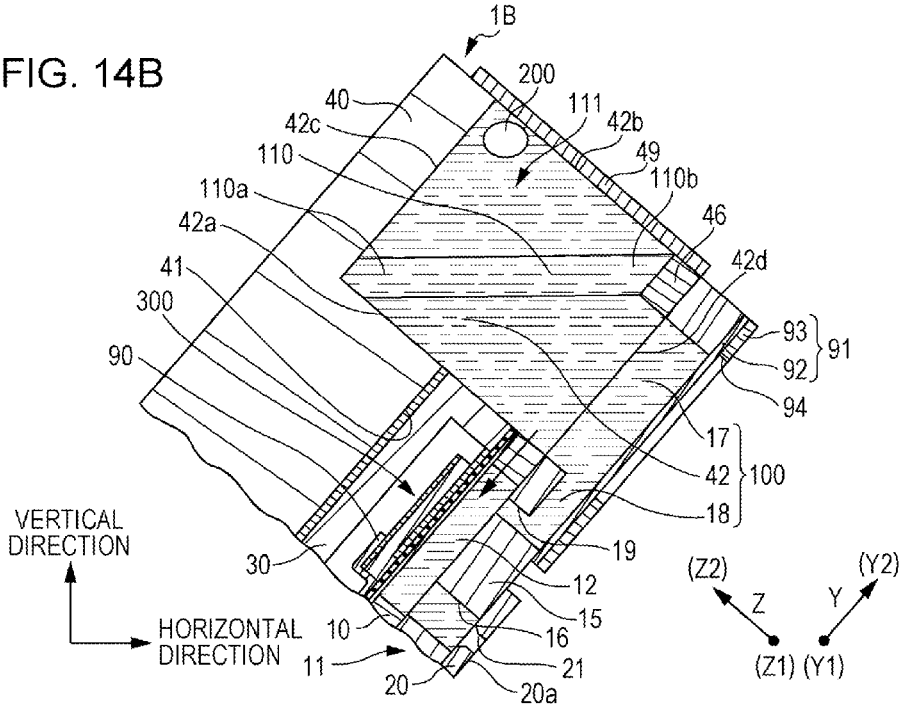

Furthermore, as illustrated in FIG. 14B, also similarly in the second ink jet type recording head 1B, the manifold 100 of the second ink jet type recording head 1B is provided by being inclined according to the angle of the liquid ejecting surface 20*a*. At this time, since the corner portion of the third side 42*c* and the second side 42*b* of the manifold 100 is disposed on the upper side in the vertical direction, but the notch section 111 exposing the corner portion of the third side 42*c* and the second side 42*b* is provided in the rib 110 of the first embodiment described above, the air bubbles 200 moves to the upper side in the vertical direction due to buoyancy and it is possible to discharge the air bubbles 200 passing through the notch section 111.

That is, in the ink jet type recording heads 1A to 1D, if the ink jet type recording heads 1A to 1D are disposed by being inclined with respect to the vertical direction, specifically, the air bubbles 200 are likely to stagnate if the rib 130 illustrated in FIG. 5 described above is provided, but it is possible to easily discharge the air bubbles 200 that are likely to stagnate by providing the notch section 111 in the rib 110 as the embodiment.

Moreover, since two manifolds 100 are provided in the ink jet type recording heads 1A and 1B, the ribs, for example, the ribs 110 to 110C may be appropriately used, which do not block the corner portion that is the upper side in the vertical direction in the other manifold 100 rather than one manifold 100 illustrated in FIGS. 14A and 14B. Furthermore, also similarly in the third ink jet type recording head 1C and the fourth ink jet type recording head 1D, if the ribs, for example, the ribs 110 to 110C having the notch section 111 exposing the corner portion that is the upper side in the vertical direction are appropriately selected, it is possible to provide the ink jet type recording heads 1A to 1D that have an excellent air bubble discharge property.

Moreover, in the examples described above, the recovery pipe 9 is connected to the liquid storage unit 5 and the ink is circulated, but the configuration is not specifically limited, and the recovery pipe 9 may be connected to a discharge liquid storage section in which the discharged ink is stored and the like other than the liquid storage unit 5, and the discharged ink may be stored in the discharge liquid storage section.

Furthermore, in the examples described above, a so-called line-type ink jet type recording apparatus I is exemplified, in which the ink jet type recording head 1 is fixed and the printing is performed only by transporting the ejection medium S, but the configuration is not specifically limited. For example, the invention can be applied to a so-called serial type ink jet type recording apparatus, in which the ink jet type recording head 1 is mounted on a carriage moving in a main scanning direction intersecting the transportation direction of the ejection medium S and the printing is performed while moving the ink jet type recording head 1 in the main scanning direction.

Furthermore, in the embodiment, the ink jet type recording apparatus I of the type in which the liquid storage unit 5 is fixed to the apparatus body 3 is exemplified, but the configuration is not specifically limited, and, for example, the invention can be applied to an ink jet type recording apparatus of a type in which a liquid storage unit such as an ink cartridge is fixed to each ink jet type recording head 1, ink jet type recording head unit 2, the carriage, or the like.

Furthermore, in the examples described above, the configuration is exemplified in which the ink is circulated inside the manifold of the ink jet type recording head, but is not specifically limited, and, for example, a configuration may be provided in which the ink passing through the pressure generation chamber 12 is circulated. Furthermore, it is possible to improve the rigidity of the case member and to allow the flow of the ink supplied from the supply path into the manifold 100 to flow to the side in which the ink is supplied to the pressure generation chamber 12, and to improve the air bubble discharge property by providing the rib similar to the above embodiment, also in an ink jet type recording head in which the ink is not circulated in the manifold or the pressure generation chamber 12.

Furthermore, in the embodiment, the ink jet type recording apparatus as an example of the liquid ejecting apparatus is described, but the invention is intended for a general liquid ejecting apparatus including a liquid ejecting head and may also be applied to a liquid ejecting apparatus including a liquid ejecting head ejecting a liquid other than ink. For example, as other liquid ejecting heads, various recording heads used for an image recording apparatus such as a printer, a color material ejecting head used for manufacturing a color filter of a liquid crystal display and the like, an organic EL display, an electrode material ejecting head used for forming an electrode of a field emission display (FED) and the like, a bioorganic material ejecting head used for manufacturing a bio-chip, and the like may be included.

CROSS REFERENCES TO RELATED APPLICATIONS

This application claims priority to Japanese Patent Application No. 2013-260686 filed on Dec. 17, 2013. The entire disclosure of Japanese Patent Application No. 2013-260686 is hereby incorporated herein by reference.

What is claimed is:

1. A liquid ejecting head comprising:

a pressure generation chamber that communicates with a nozzle opening;

a pressure generation unit configured to generate a change in a pressure in the pressure generation chamber;

a manifold that communicates with a plurality of pressure generation chambers; and a rib that is provided inside the manifold, wherein the rib is formed over the manifold in a direction intersecting a liquid flowing from an inflow path to an outflow path of the manifold, the inflow path configured to supply the liquid through the manifold to the outflow path.

2. The liquid ejecting head according to claim 1, wherein the manifold includes a first side and a second side that face each other in a direction crossing the flowing direction of the liquid, and a third side and a fourth side that face each other in a direction intersecting a direction facing the first side and the second side, wherein the manifold and the pressure generation chamber communicate with each other on a side of a corner portion at which the first side and the fourth side of the manifold are connected, and wherein the rib is configured such that one end thereof is connected to at least one of the first side and the third side, and the other end thereof is connected to the other side of the first side and the third side, and to at least one side selected from the second side and the fourth side.

3. A liquid ejecting apparatus comprising: the liquid ejecting head according to claim 2.

4. The liquid ejecting head according to claim 1, wherein the rib is formed over a diagonal line of the manifold when the manifold is viewed in the flowing direction.

5. A liquid ejecting apparatus comprising: the liquid ejecting head according to claim 4.

6. The liquid ejecting head according to claim 1, wherein the manifold is formed in such a manner that a concave section provided in a first member is covered by a second member.

7. A liquid ejecting apparatus comprising: the liquid ejecting head according to claim 6.

8. The liquid ejecting head according to claim 1, further comprising: an outflow path through which the liquid inside the manifold flows out.

9. A liquid ejecting apparatus comprising: the liquid ejecting head according to claim 8.

10. The liquid ejecting head according to claim 1, wherein a plurality of ribs are provided inside the manifold in the flowing direction of the liquid and the plurality of ribs are positioned in different positions viewed from the flowing direction of the liquid.

11. A liquid ejecting apparatus comprising: the liquid ejecting head according to claim 10.

12. A liquid ejecting apparatus comprising: the liquid ejecting head according to claim 1.

13. The liquid ejecting apparatus according to claim 12, wherein a plurality of liquid ejecting heads are provided in a direction in which liquid ejecting surfaces from which nozzle openings open intersect each other.

14. The liquid ejecting head according to claim 1, wherein the rib is configured to move a center of the liquid flowing to a side of the pressure generation chamber.

15. A liquid ejecting head comprising:

a pressure generation chamber that communicates with a nozzle opening;

a pressure generation unit that generates a change in a pressure in the pressure generation chamber;

a manifold that communicates with a plurality of pressure generation chambers; and a rib that is provided inside the manifold, wherein the rib is formed over the manifold, wherein the rib is generally elongate and narrow, wherein a longitudinal direction of the rib is transverse to a direction of flow of a liquid inside the manifold, and wherein the rib divides the flow of the liquid inside the manifold into two.

16. A liquid ejecting head comprising:

a pressure generation chamber that communicates with a nozzle opening;

a pressure generation unit that generates a change in a pressure in the pressure generation chamber;

a manifold that communicates with a plurality of pressure generation chambers; and a rib that is provided inside the manifold, wherein the rib is formed over the manifold, and wherein the rib divides the flow inside the manifold into two;

wherein the manifold includes a first side and a second side that face each other in a direction crossing the flowing direction of the liquid, and a third side and a fourth side that face each other in a direction intersecting a direction facing the first side and the second side, wherein the manifold and the pressure generation chamber communicate with each other on a side of a corner portion at which the first side and the fourth side of the manifold are connected, and wherein the rib is configured such that one end thereof is connected to at least one of the first side and the third side, and the other end thereof is connected to the other side of the first side and the third side, and to at least one side selected from the second side and the fourth side.

* * * * *